US007789006B2

(12) United States Patent
Walker

(10) Patent No.: US 7,789,006 B2
(45) Date of Patent: Sep. 7, 2010

(54) PERFORATING GUN LOADING BAY, TABLE AND METHOD

(75) Inventor: Troy S. Walker, Red Deer (CA)

(73) Assignee: Walker's Holdings Inc., Red Deer (CA)

( * ) Notice: Subject to any disclaimer, the term of this patent is extended or adjusted under 35 U.S.C. 154(b) by 0 days.

(21) Appl. No.: 11/858,035

(22) Filed: Sep. 19, 2007

(65) Prior Publication Data

US 2008/0257138 A1 Oct. 23, 2008

Related U.S. Application Data

(60) Provisional application No. 60/826,182, filed on Sep. 19, 2006.

(51) Int. Cl.
*F42B 33/00* (2006.01)

(52) U.S. Cl. ..... 86/50; 86/1.1; 89/36.04; 89/36.07; 89/36.15

(58) Field of Classification Search ..... 86/50, 86/1.1; 89/36.04, 36.07, 36.15
See application file for complete search history.

(56) References Cited

U.S. PATENT DOCUMENTS

| | | | | |
|---|---|---|---|---|
| 1,371,322 | A * | 3/1921 | Mikaelson | 74/423 |
| 3,093,098 | A * | 6/1963 | Rosenfeld | 109/1 S |
| 3,142,271 | A * | 7/1964 | Aden | 109/1 S |
| 3,301,041 | A | 1/1967 | Mueller | |
| 3,385,073 | A | 5/1968 | Snelling | |
| 3,946,950 | A | 3/1976 | Graf | |
| 4,276,725 | A | 7/1981 | Ash | |
| 4,325,309 | A | 4/1982 | King et al. | |
| 4,632,041 | A * | 12/1986 | Ohlson | 109/1 S |
| 4,730,718 | A | 3/1988 | Fazio et al. | |
| 5,135,130 | A | 8/1992 | Andrews | |
| 5,248,055 | A | 9/1993 | Sanai et al. | |
| 5,495,812 | A | 3/1996 | Schulze | |

(Continued)

FOREIGN PATENT DOCUMENTS

| | | |
|---|---|---|
| CA | 2418362 | 2/2004 |

(Continued)

OTHER PUBLICATIONS

Photo of a Perforating Gun Loading Bay, pre. Feb. 5, 2002.

*Primary Examiner*—Troy Chambers
*Assistant Examiner*—Samir Abdosh
(74) *Attorney, Agent, or Firm*—Bennett Jones LLP

(57) ABSTRACT

A perforating gun loading bay includes a loading area and a separate gun component storage area. The perforating gun loading area also includes racks and a table that permit an in-line loading operation such that the gun housing and loaded gun need not be moved out of a linear path from introduction to the bay to unloading from the bay. The racks and the table may be position in axial alignment and may include low friction members to permit axial sliding motion along the racks and the table. A method for using the loading bay permits in-line handling. A perforating gun loading table includes low friction members permitting axial movement of perforating gun components therealong and low friction members permitting rotational movement of perforating gun components along their long axis. The perforating gun loading table includes a control system for selecting the low friction member that is positioned to engage the perforating gun component on the table.

18 Claims, 19 Drawing Sheets

U.S. PATENT DOCUMENTS

| | | | | |
|---|---|---|---|---|
| 5,609,236 | A | 3/1997 | Neukam | |
| 5,732,510 | A * | 3/1998 | Sutton et al. | 52/1 |
| 5,875,996 | A | 3/1999 | Borgia | |
| 5,884,709 | A | 3/1999 | Evans et al. | |
| 6,138,420 | A | 10/2000 | Fyfe | |
| 6,173,662 | B1 * | 1/2001 | Donovan | 110/237 |
| 6,196,107 | B1 | 3/2001 | Hoffman et al. | |
| 6,212,840 | B1 * | 4/2001 | Davidovitz | 52/506.01 |
| 6,354,181 | B1 * | 3/2002 | Donovan | 86/50 |
| 7,308,847 | B2 * | 12/2007 | Walker | 86/50 |
| 2004/0020349 | A1 * | 2/2004 | Walker | 86/50 |
| 2004/0107823 | A1 * | 6/2004 | Kiley et al. | 86/50 |

FOREIGN PATENT DOCUMENTS

| | | |
|---|---|---|
| DE | 4233082 | 3/1997 |

* cited by examiner

PERFORATING GUN LOADING BAY, TABLE AND METHOD

FIELD OF THE INVENTION

The present invention relates to a perforating wireline gun loading and, in particular, a bay in which and a method for which the explosives for perforating guns can be handled and loaded while mitigating the risk of damage due to accidental detonation.

BACKGROUND

Explosives are used widely throughout the world for a variety of applications including oilfield and mining. One application of explosives used commonly in the oil industry is the use of perforating guns, which are also termed wireline guns. The perforating guns are tubular assemblies that contain a series of explosive shaped charges. When detonated the shaped charges create a molten high-pressure jet that creates a perforation into the hydrocarbon bearing formation. The hydrocarbons can then flow into the wellbore for production of the well.

These perforating guns are commonly loaded (with shaped explosive charges) in shops or specially designated areas for safety concerns. These requirements are set by the government agencies in charge of explosive regulation. These requirements include the use of explosive magazines for storage of explosive charges and detonators and the use of shock absorbing mats in the loading areas. Security is often an issue since these areas are often open to the remainder of the shop. However, it is desirable that the areas be secured to ensure only trained personnel have access to explosives.

However, recently, it has become apparent that present loading facilities sometimes do not adequately address the risk of injury to personnel and equipment should an accidental detonation occur. In particular, the shrapnel generated by an accidental detonation perforating gun detonation can pass into adjacent open or separated work areas injuring personnel who are not at all involved in the handling of explosives or in the industry of perforating guns in general. To mitigate this risk, it has been proposed that any bay for handling perforating gun explosives be isolated to provide, what is termed a "safe quantity distance" between the loading bay and adjacent unrelated shops and people. For perforating gun-sized explosive handling, of for example, less than 20 kg explosives, the safe quantity distance can be for example 270m. As will be appreciated, this has complicated perforating gun loading operations as it is often very difficult to provide safe quantity distance about the entire bay.

Another problem that must be addressed is relating to storage of the explosives. Explosives must be maintained in secured storage areas when not being handled to prevent access by unauthorized personnel. This often requires that the explosive be transported into and out of magazines on a regular basis, which increases the chances of accidents.

Considerations need to be made for mitigating the risks of perforating gun explosives handling.

SUMMARY OF THE INVENTION

This patent describes a perforating gun loading table, a perforating gun loading bay and method for mitigating some of the risks in the loading and handling of the explosive charges used in perforating guns.

In accordance with a broad aspect of the invention, there is provided a perforating gun loading bay comprising: outer walls for mitigating the passage of explosive debris therethrough; a storage area within the outer walls including storage racks for accommodating at least perforating gun housings; a perforating gun loading area within the outer walls; a blast mitigation wall within the outer walls extending between the storage area and the perforating gun loading area; and a worker walk way through the blast mitigation wall.

In accordance with another broad aspect of the invention, there is provided a perforating gun loading bay comprising: outer walls for mitigating the passage of explosive debris therethrough, the outer walls defining an inner space; a port through at least one of the outer walls; a pipe rack installed within the inner space, the pipe rack having pipe support surface and a long axis, the pipe rack positioned with its long axis aligned with the port; and a perforating gun loading table positioned within the inner space, the perforating gun loading table including a gun supporting surface and having a long axis, the perforating gun long axis being substantially aligned with the long axis of the pipe rack and being positioned directly adjacent the pipe rack with its gun supporting surface positioned substantially continuously with the pipe support surface.

In accordance with another broad aspect of the invention, there is provided a method for loading a perforating gun comprising: providing a pipe rack and a perforating gun loading table positioned adjacently; loading a perforating gun housing onto a pipe rack; sliding the perforating gun housing along the pipe rack; sliding the perforating gun housing from the pipe rack to the perforating gun loading table while the perforating gun housing remains supported on at least one of the pipe rack and the perforating gun loading table; and loading explosives to the perforating gun housing to obtain a loaded perforating gun.

In accordance with another broad aspect of the invention, there is provided a perforating gun loading table comprising: a work surface defining a long axis and including axial movement-permitting rollers having an axis of rotation substantially orthogonal to the long axis and rotational movement-permitting rollers having an axis of rotation substantially parallel to and offset from the long axis; and a control system to raise and lower at least one of the axial movement-permitting rollers and the rotational movement-permitting rollers relative to the other.

In accordance with another broad aspect of the invention, there is provided a method for loading a perforating gun comprising: providing a perforating gun loading table including a long axis, axial movement-permitting rollers having an axis of rotation substantially orthogonal to the long axis and rotational movement-permitting rollers having an axis of rotation substantially parallel to and offset from the long axis; placing a perforating gun strip onto the rotational movement-permitting rollers; loading explosives to the perforating gun strip while rotating the strip about its long axis on the rotational movement-permitting rollers; and sliding a perforating gun outer housing along the axial movement-permitting rollers to telescopically move over the strip and to leave the perforating gun outer housing supported on the axial movement-permitting rollers with the strip and explosives positioned within the outer housing.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention.

Accordingly the drawings and detailed description are to be regarded as illustrative in nature and not as restrictive.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings:

FIG. 3*c* is an underside view corresponding to the configuration of FIG. 3*a* and FIG. 3*e* is the underside view corresponding to the configuration of FIG. 3*b*.

DESCRIPTION OF THE INVENTION

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Figure 1:
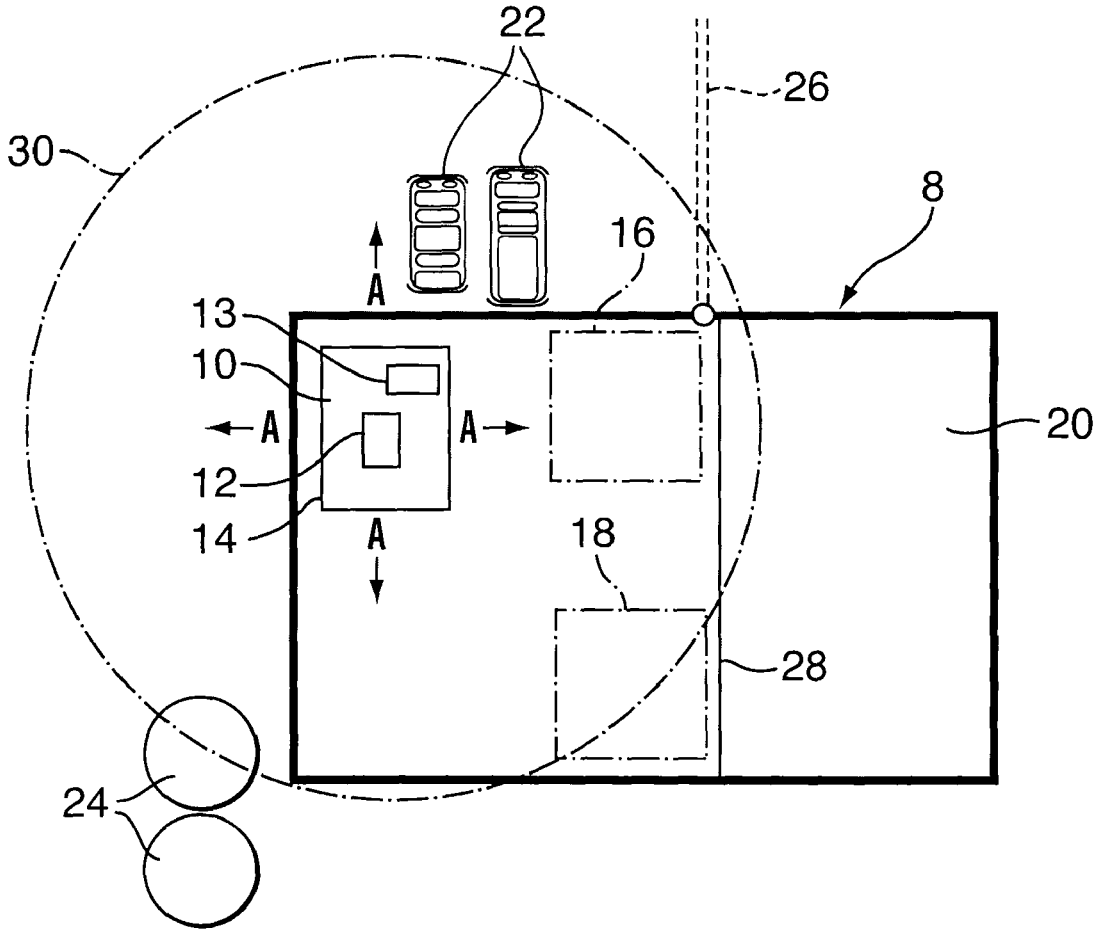
FIG. 1 PRIOR ART
FIG. 1 is a schematic layout view of a prior art-perforating gun loading shop.

FIG. 1 shows a schematic layout of a typical prior art perforating gun loading shop 8 including a loading area 10 including a bench 12 on which the gun is loaded and a magazine 13 in which the explosives for the gun are stored. The loading area, as is common practice, is identified in the shop by a red line 14 which indicates a risk area into which entry is permitted only by authorized personnel. Generally, the area will contain less than 20 kg of explosives including those in the magazine and in guns. Some safety measures may be followed within the loading area such as the use of shock absorbing mats, etc.

According to prior art practice an unloaded wireline gun or several guns are brought into loading area 10 within red line 14 and set, for example, on the bench. The gun is then loaded by: disassembling the gun, removing explosives from magazine 13, installing the explosives in the gun and reassembling the gun. The most dangerous steps in this process are during carriage of the explosives from the magazine to the gun, during installation to the gun and during reassembly of the gun.

Often in and around the shop, there are personnel working in other areas 16, 18 and in offices 20, equipment, such as vehicles 22, liquid and gas fuel tanks 24, gas lines 26 (for example extending underground), stored chemicals and radioactive sources. These people and equipment are often separated from the loading area 10 only by the red line or by thin interior walls 28 or exterior walls and are within a damage zone, indicated at 30, should an accidental detonation occur. In particular, should a detonation occur, shrapnel would be trajected in all directions, arrows A, about, for example, 360° within zone 30. This may cause injury or death to personnel in areas 16, 18 and in offices 20, damage to equipment and secondary dangers such as explosions of stored fuel or release of harmful chemicals. Damage may also be caused to under ground structures such as gas lines 26.

In view of the foregoing, it has been considered to require significant safe quantity distance about gun loading shops, which may require many shops to be relocated at significant cost. However, it is often necessary, even where the shop itself is located, that unrelated personnel, such as office staff, or other trades people, remain in close proximity to the loading area and, therefore, in danger should an accidental blast occur.

A perforating gun loading facility has been described in applicant's corresponding US patent application publication no. 2004-0020349-A1, published Feb. 5, 2004, incorporated herein by reference.

Further aspects of a perforating gun loading facility are considered herein. Also, a perforating gun loading table has been invented for use in a perforating gun loading blast resistant structure or otherwise.

Figure 2:
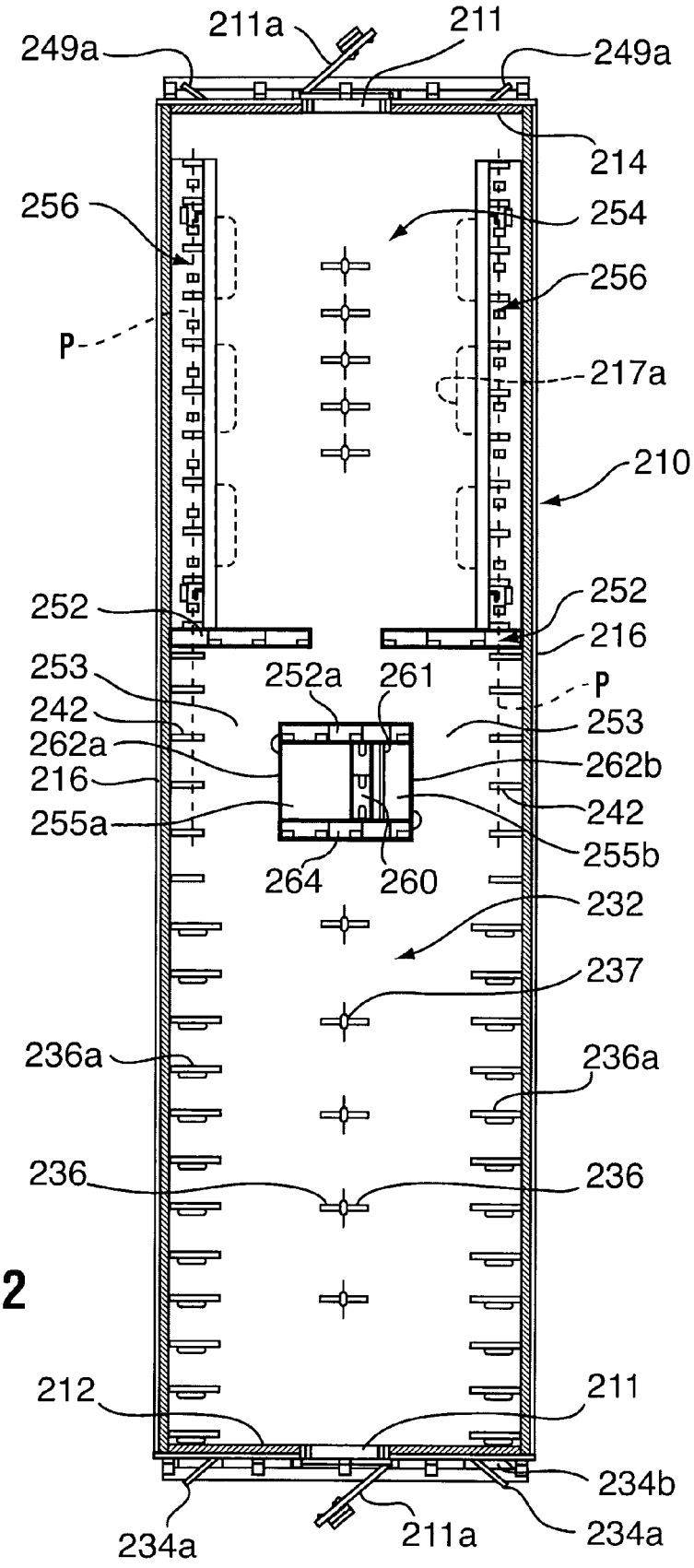
FIG. 2 is a schematic layout view of the perforating gun loading bay according to one aspect of the present invention.
Figure 2A:
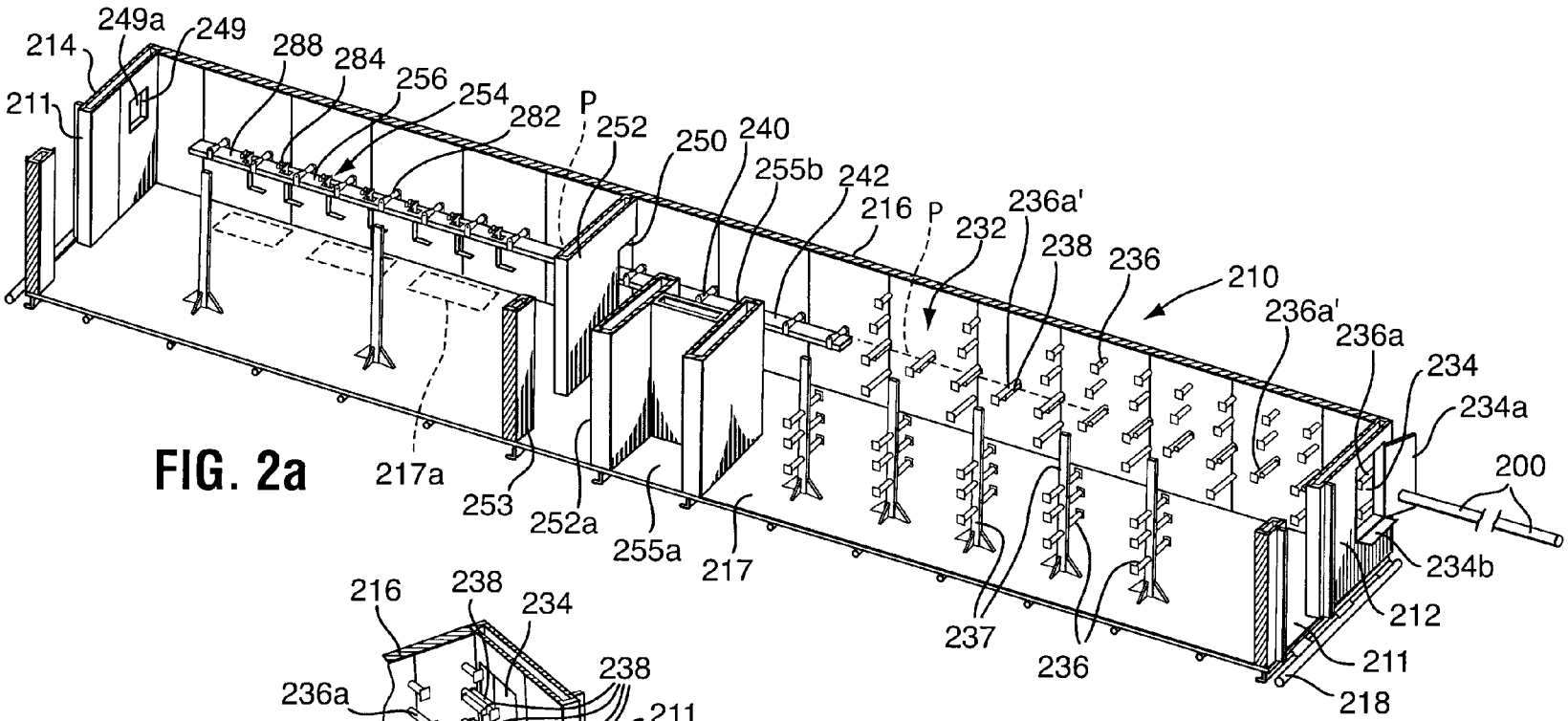
FIGS. 2*a* to 2*q* are top perspective cutaway views of a loading bay showing a gun loading process.
Figure 2B:
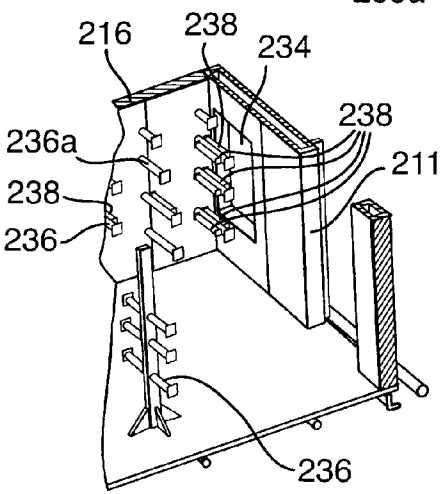
Figure 2C:
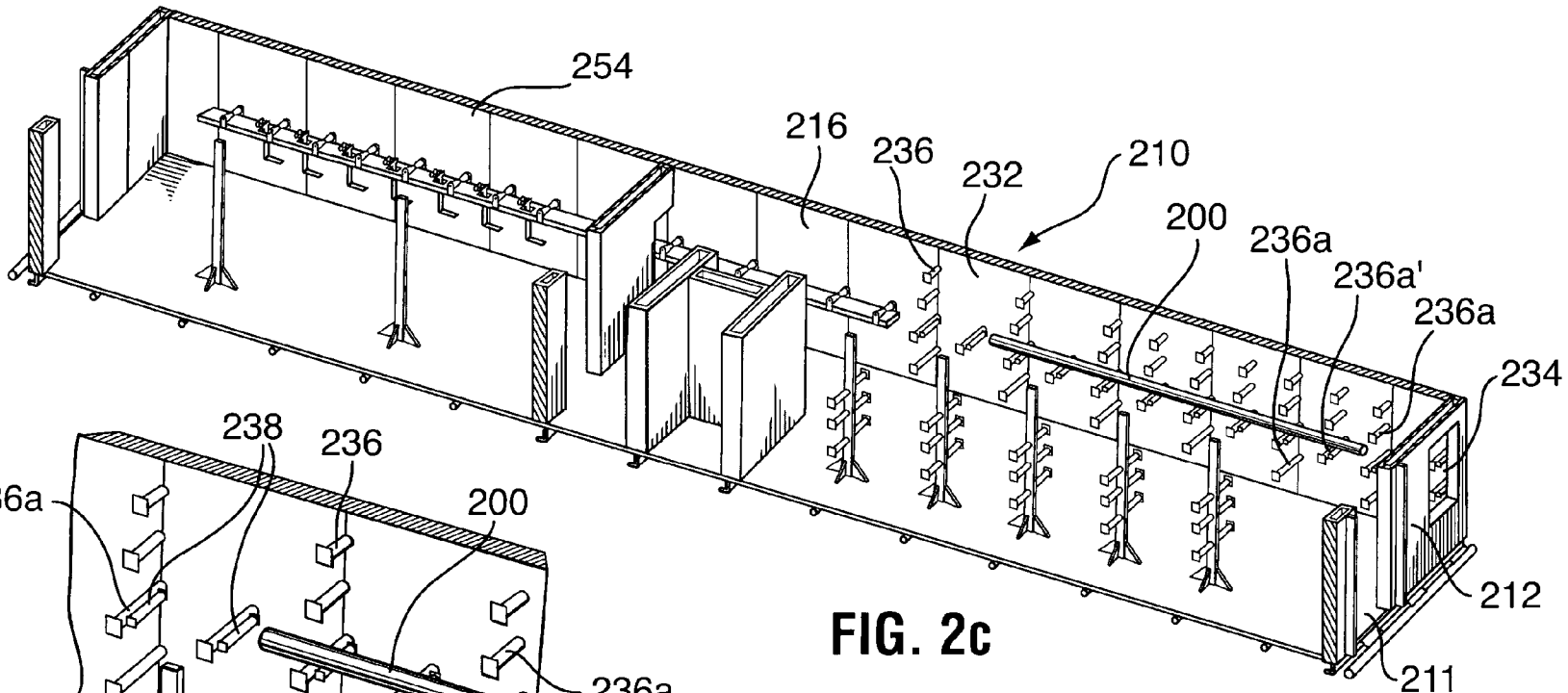
Figure 2D:
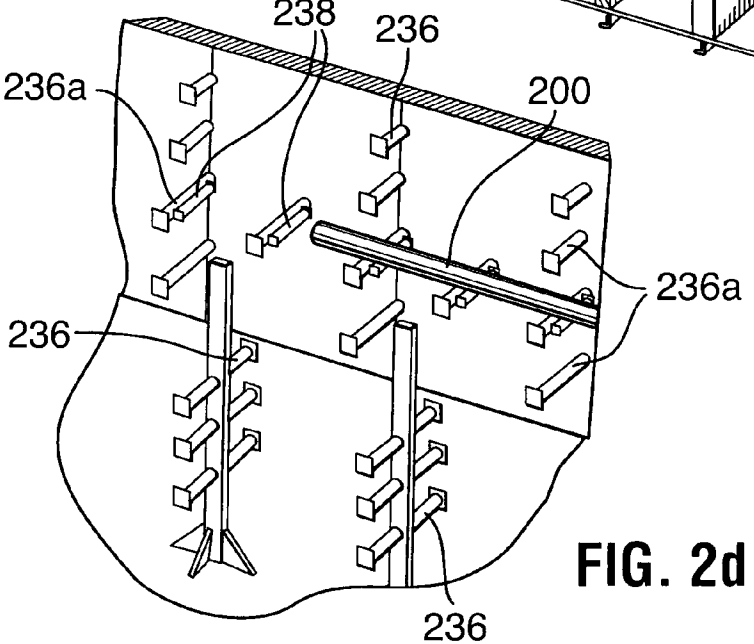
Figure 2F:
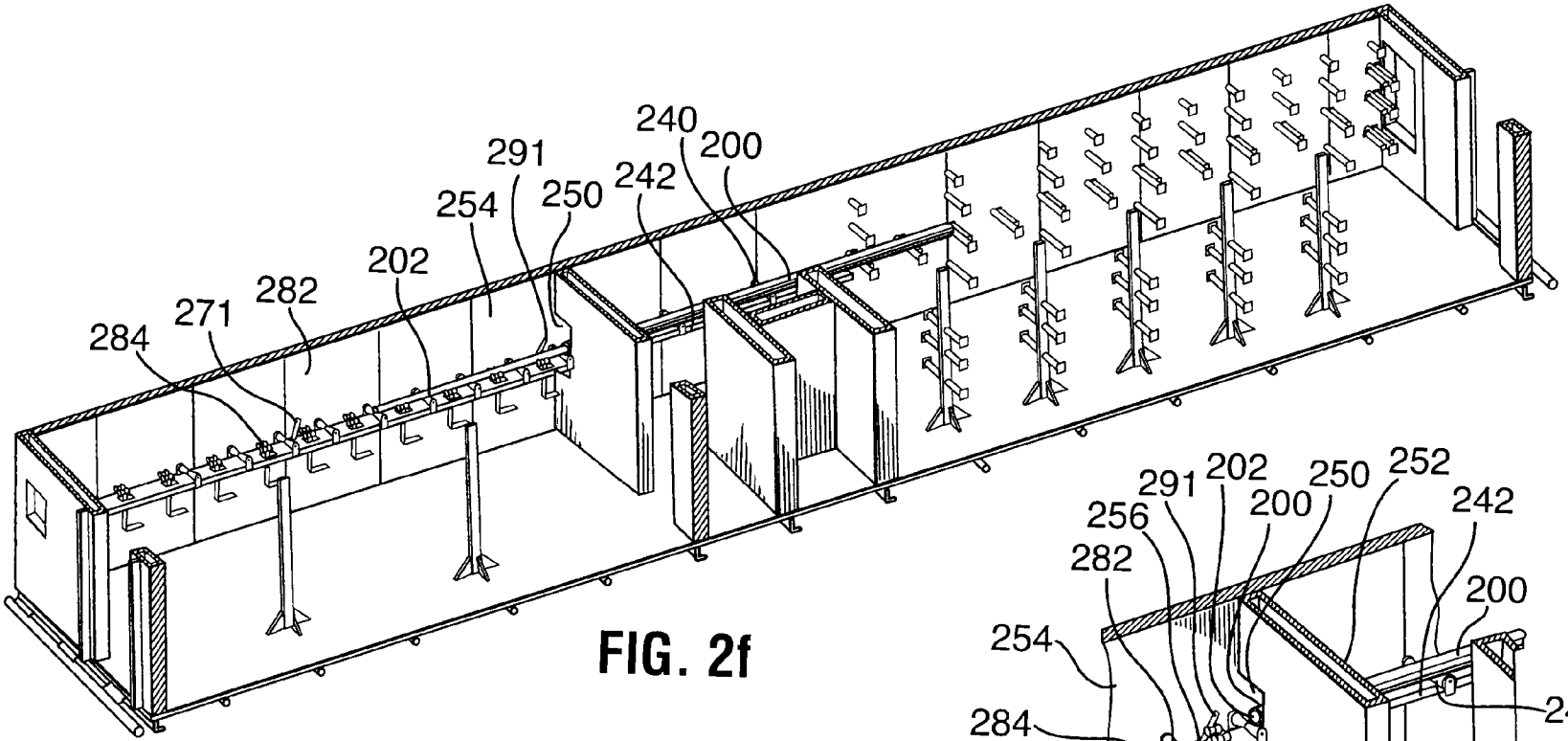
Figure 2E:
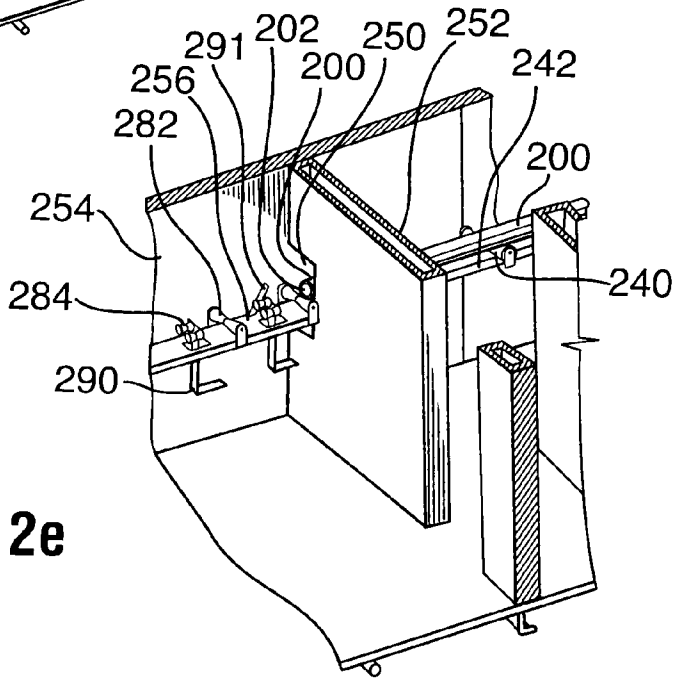

With reference to FIG. 2, one embodiment of a perforating gun loading facility 210 is shown in plan view. FIGS. 2*a* to 2*q* show a similar perforating gun loading facility with portions removed to facilitate illustration thereof.

Facility 210 may include end walls 212, 214, side walls 216, floor 217 and roof (removed in all views) to enclose an internal space. One or more doorways 211 may be provided for ingress and egress. The doorways, walls, floor and roof may be selected to have blast resistant properties, for example, to shock absorb, contain, selectively release, etc. the force of a blast. In one embodiment for example, walls, floor and roof may include plate steel layers and possibly inner cavities filled with shock absorbing materials such as gravel, sand, cement, etc. In another embodiment, floor and roof may include blow out panels, such as floor panels 217*a* to select the release path for blast energy. In addition, walls, floor and roof and access ways therethrough may be selected to act against unauthorized entry, such as by including locked closures 211*a* in doorways 211. Generally, to facilitate escape, more than one doorway may be provided. In one embodiment, doorways 211 are sized and configured to facilitate escape, as by being sized for passage of an adult in an upright walking position and installing closures 211*a* to open outwardly and with a panic release.

Facility 210 may be constructed in a way that is fixed with respect to location or may be transportable, as by inclusion of a skid arrangement 218. Examples of these and other aspects of an embodiment of a gun loading facility may be better understood by reference to applicant's aforementioned US application.

When loading a perforating gun, one of the most dangerous procedures is the actual loading process. As will be appreciated, the perforating gun components without explosives, such as empty housings, are much less dangerous than the explosives alone and explosive-containing components. Also, generally a fully assembled perforating gun presents less explosive risk than a partially loaded gun or loose explosives. The presently illustrated facility offers separate areas for storage and loading of perforating guns and components therefore. As such, the presently illustrated facility may offer a measure of protection against sympathetic detonation and added safety for workers in the less dangerous areas of a loading facility.

In one embodiment, facility 210 may include a storage area 232 and a loading area 254. These areas may be separated by a blast resistant, blast mitigation wall 252. One or more magazines 255*a*, 255*b* may be provided for explosive component storage.

Blast mitigation wall 252 may be positioned and formed to act as a shield between areas 232, 254, and may be formed with consideration as to the activities being performed in the two areas. One significant consideration, for example, is the location of gun loading that that is occurring in area 254. For example, gun loading usually occurs at a table 256 and if an explosion does occur it may occur near the table. In an explosion during the loading of a gun, debris and blast energy generally travels axially from the ends and radially outwardly from the sides of the gun being loaded. As such, wall 252 can be positioned to block linear communication between the location of the table and storage area 232.

Blast mitigation wall 252 may include a human walking passageway 253 therethrough to permit worker movement (i.e. adult upright walking) between areas 232, 254. Passageway 253 may include a door thereon or may remain open, as shown. If passageway 253 remains open or if there is any desire for added blast mitigation, a secondary wall 252*a* may be provided to block direct linear access between storage area 232 and loading area 254. Secondary wall 252*a*, for example, may block linear travel of blast energy through passageway 253 from one area to the other area, which may therefore dissipate some energy of any blast. In the illustrated embodiment, secondary wall 252*a* is incorporated to the structure forming magazines 255*a*, 255*b*. However, if desired, any secondary wall can be a stand alone structure.

Any exterior doorways 211 from loading area 254 may also be positioned with consideration as to the location of loading tables 256 and the direction of any blast generated therefrom.

Storage area 232 may include various elements to facilitate handling including loading, unloading, movement, etc. of guns and gun components about the area and various elements to facilitate storage of guns and gun components and effective use of the area.

For example, in one embodiment, storage area 232 includes a gun handling port 234 through an exterior wall thereof. In the illustrated embodiment, port 234 opens through end wall 212. Port 234 includes a closeable and lockable door 234*a* and may be sized to permit a gun housing to be moved therethrough, in line with the gun's long axis. In one embodiment, a shelf 234*b* is mounted on the bay exterior adjacent the gun handling port to provide a support surface for a gun during moving guns into and out of the bay.

Within area 232, racks 236 are provided for storage of guns and gun components. Racks 236 may be formed in various ways to accommodate the guns and gun components, which generally are cylindrical elongate members. Racks 236, for example, may be formed as pipe racks with continuous or substantially continuous shelves, hooks, straps, etc. or as shown, spaced apart arms with end stops. In the illustrated embodiment, a rack 236 may be defined by a horizontal row of spaced arms resembling a pipe rack. Racks 236 may be vertically spaced in various locations about area 232 for effective use of the space therein. For example, some racks may be positioned against the walls of the storage area and other racks may be installed on posts 237 in locations away from the walls. One or more hoists (not shown), such as pulley and chain arrangements, may be supported, for example from the ceiling, within area 232 to facilitate movement of guns and gun components about the area.

Some racks may be positioned in line with port 234 to provide a support onto which a gun can be placed before or after passing through the port. For example, in the illustrated embodiment, port 234 and some wall-mounted racks 236*a* are positioned correspondingly such that the racks are aligned with the opening of port 234. As such, a gun being passed though port 234 can be placed directly on one of racks 236*a*.

To facilitate the movement of guns and housings over the racks, some of the racks may be provided with friction reducing members such as low friction pads, bearings or, as shown, rollers 238. Generally, movement of a gun laterally over a rack is not a concern, as perforating guns are often cylindrical and roll easily. However, movement of a gun in a direction along the gun's long axis can be more difficult. Thus, it is desired any friction reducing members are provided to facilitate such axial movement over the racks. For example, rollers 238 may be provided that rotate about an axis orthogonal to the length of the rack so that a gun component placed thereon can be slid on the rollers axially along the length of the rack. In the illustrated embodiment, rollers 238 are provided on some of the racks 236*a* adjacent the pipe handling port such that a gun housing placed thereon can be slid on the rack through port 234. In another embodiment, rollers 238 may be provided along the length of a rack, such as rack 236*a*', to facilitate movement of components over the rack along its length.

In one embodiment, facility 210 is laid out to facilitate handling and loading of guns. For example, areas 232 and 254 may be correspondingly laid out to permit handling and loading while minimizing lifting and repositioning of the guns. Areas 232 and 254 may for example include an arrangement of a rack and a loading table that are aligned and positioned at the same height off the floor such that a gun housing to be loaded can moved in line along the rack and the table from a housing storage area to the loading table, loaded and then moved from the loading table, all while being fully supported by the rack and the table. The rack and the table may include friction reducing members to facilitate axial sliding movement of the gun and gun components. A facility may include one or more such arrangements of the rack and the table such that more than one loading operation may occur at the same time in the same facility. For example, FIG. 2 shows a facility including two inline arrangements for handling and loading perforating guns. Other facilities may include only one arrangement or more than two arrangements.

In one embodiment, for example, a transfer rack 242 may be provided between a storage rack, in this embodiment racks 236*a*', and loading table 256. Rack 236*a*', transfer rack 242 and loading table 256 may all be axially aligned both with respect to height above floor 217 and lateral positioning, defining therebetween a linear pipe movement path P. In one embodiment, racks 236*a*', 242 and table 256 may all be installed in fixed locations in the facility.

In one embodiment, port 234 may also be positioned in line with path P such that a gun housing can be introduced and passed along path P directly. In another embodiment, another port 249 with a closeable and lockable closure 249*a* may also be provided through an exterior wall of loading area 254 through which a gun may be passed. Again, port 249 may also be positioned along path P.

If a mitigation wall 252 is provided to divide the facility into a storage area and a loading area, an access port 250 may be formed through the wall to accommodate the in line movement. In particular, port 250 may be positioned along path P. Port 250 may be raised off the floor and may be sized to accommodate the passage of a gun housing therethrough. Port 250, for example, may be sized to define an opening bigger than the diameter of any gun housing to be moved therethrough. However, to reduce the passage of blast energy therethrough, the size of port 250 should be minimized as much as possible.

Transfer rack 242 may be positioned between a storage rack and a loading table. The transfer rack may be positioned in storage area 232 or loading area 254 or may span therebetween. In the illustrated embodiment, transfer rack 242 is positioned mostly in storage area 232 with a portion thereof extending through port 250. Rack 242 may include rollers thereon to facilitate movement of a gun or housing axially along therealong. In one embodiment, as illustrated, rollers 240 are provided on the transfer rack, that rotate about an axis orthogonal to the length of the rack and that also act to select a lateral position of the gun housing thereon. For example, rollers 240 may be of the V-grooved type (also sometimes called concave, hourglass, flanged, spool, etc.) to cause indexing of the housing, causing it to roll to the lowest point along the roller tube surface so that any housing conveyed therealong will be in a selected side to side position on the rack.

Loading table 256 may take various forms including, for example, a planar bench, various supports for holding the gun against unwanted movement on the table, etc. One embodiment of a perforating gun loading table is shown with reference also to FIG. 3. In the illustrated embodiment, the loading table includes a support, low friction surfaces permitting axial and rotational movement of the gun and table controls.

The support may include legs 286 (FIG. 3), wall supported brackets (FIG. 2), support rails, a frame, etc. which supports the low friction surfaces at a working height. A work surface 288 may be installed under the low friction surfaces. Work surface 288 may be solid, as shown, apertured, etc. as desired. In one embodiment, as shown, work surface 288 includes a tray 289 for holding and collecting parts. A solid work surface may be useful to collect dropped parts and explosive dust, preventing them from accumulating on the floor.

The illustrated table includes low friction surfaces to permit both axial and rotational movement of a gun housing placed thereon and a control system to move at least some of the low friction surfaces between acting and non-acting positions and/or to lock and unlock components as desired. As such, a perforating gun on the table may be supported and moved through one or more directions, as permitted by the control system, depending on the activities being performed. For example, table 256 may include rollers 282 permitting axial movement of a gun component, such as a part of a housing, placed thereon. Rollers 282, for example, may be provided on the table, that each rotate, arrows R1, about an axis substantially orthogonal to the length of the table and that also act to select a lateral position of the gun housing thereon. For example, rollers 282 may be of the V-grooved type to cause the housing to roll to, and stay at, the lowest point along the roller tube surface so that any housing conveyed therealong is positioned in a selected side to side location.

If the present table is used with an in line gun loading set up and/or a transfer rack, rollers 282 may be positioned to act in path P and may be aligned with rollers 240. For example the V-grooves of the rollers 282 and 230 may be substantially aligned.

Table 256 may further include rollers 284 permitting rotational movement of the gun on the table, for example, to rotate a gun housing about its long axis. Rollers 284 may include paired rollers 284*a*, 284*b* that each rotate, arrows R2, about an axis substantially parallel with the length of the table. Paired rollers 284*a*, 284*b* may be positioned oppositely, as shown or offset, but create a V-shaped groove therebetween into which the cylindrical form of a gun housing can rest and be rotated. The paired rollers may be positioned to correspond to the shape and length of a gun housing as it is held on rollers 282, for example with consideration as to the position of their V-grooves. For example, at a minimum two rollers 282 may be used with their V-grooves aligned, for example along path P, and at a minimum three rollers 284 are required, with three rollers 284 positioned with at least one on a first side of path P and at least two on the other side of path P, all of rollers 284 having axis of rotation substantially parallel with path P. In one embodiment, the rollers 284 may be equally spaced on either side of path P.

Rollers 282, 284 may be replaced by other low friction surfaces such as low friction pads, bearings, such as ball bearings, etc.

As will be appreciated, it may be desirable to restrict the movement permitted by the table at any particular time. For example, it may be useful to control the operation of the table to allow movement of a gun either rotationally or axially, but not both at the same time. In one embodiment, for example, the table may be configured such that if the low friction surfaces permitting rotational movement are in the active position, the low friction surfaces permitting axial movement are in an inactive position such that any component supported on the table can only be moved rotationally but not axially. Thus, a control system may be provided to move at least some of the low friction surfaces between an active position and an inactive position. Considering the use of rollers 282, 284, for example, a control system may be provided to raise or lower either of the roller sets (i.e. a plurality of rollers 282 or a plurality of rollers 284) in relation to the other, the highest roller set being the one that is positioned to support the gun. In one embodiment, one of the roller sets is maintained stationary while the other is controlled to be raised or lowered. A control system can be provided to raise or lower the selected roller set and may include one or more locks to fix the selected roller set against accidental movement.

In the illustrated embodiment, for example, a control system is provided to raise and lower rollers 284, while rollers 282 are height fixed on a raised frame 287. The control system in one mode drives rollers 284 between an active position in which their roller surface is raised above that of rollers 282 and an inactive position wherein the roller surface of rollers 284 are recessed below the roller surface of rollers 282. Although the control system may take various forms, in one embodiment, the control system includes an actuator arm 291 that can be moved from one position to another to drive vertical movement of the rollers. In the illustrated embodiment, rollers 284 are mounted for pivotal movement between an active, upright position and an inactive, tilted down position. In particular, roller pairs 284 are each mounted on a frame 290 that is pivotally connected by a hinge 292 to a portion of the table such as the frame support or work surface 288, as shown. Actuator arm 291 may be useful to drive more than one of the rollers simultaneously to move. For example, actuator arm 291 may be formed to drive a system that acts for a plurality of the frames 290 to tilt them about their hinges 292. In the illustrated embodiment, for example, actuator arm 291 acts as a lever about a fulcrum 293 and engages a rod 294. Rod 294 in turn includes a plurality of protrusions 295 that drive against frames 290 to drive them down about their hinges 292, which moves the rollers 284 mounted on the frames into an inactive, recessed position. In the illustrated embodiment, frames 290 include bottom weights 296 that bias the frames into an upright, active position on hinges 292.

Therefore, rollers 284 will be normally in an active position unless urged down by the action of rod 294. The rod and protrusions can be positioned above or, as shown, along the underside of the work surface.

Figure 3:
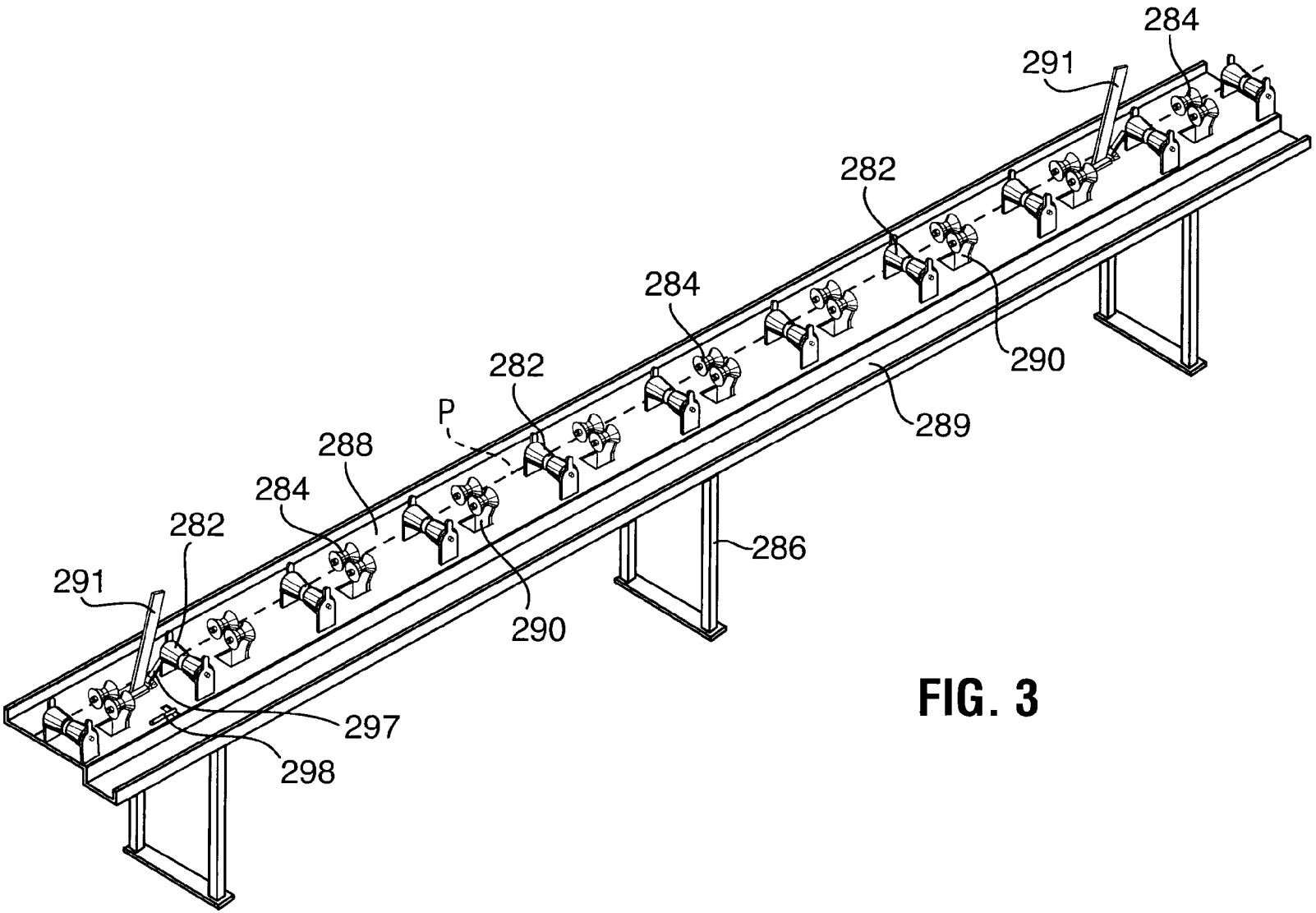
FIG. 3 is a top perspective view of a perforating gun loading table according to one aspect of the present invention.

The control system may include more than one actuator arm 291, as shown in FIG. 3. The plurality of arms 291 may be provided to each control a section of the table or to provide actuation of the entire system from a plurality of locations to minimize the need for worker movement thereabout.

The control system may further include one or more locks to lock the rollers 284 in the active and/or inactive positions. The illustrated control system includes a lock 297 to releasably fix the rollers in the inactive, lower position and a lock 298 to releasably fix the rollers in the upright, active position.

Figure 3A:
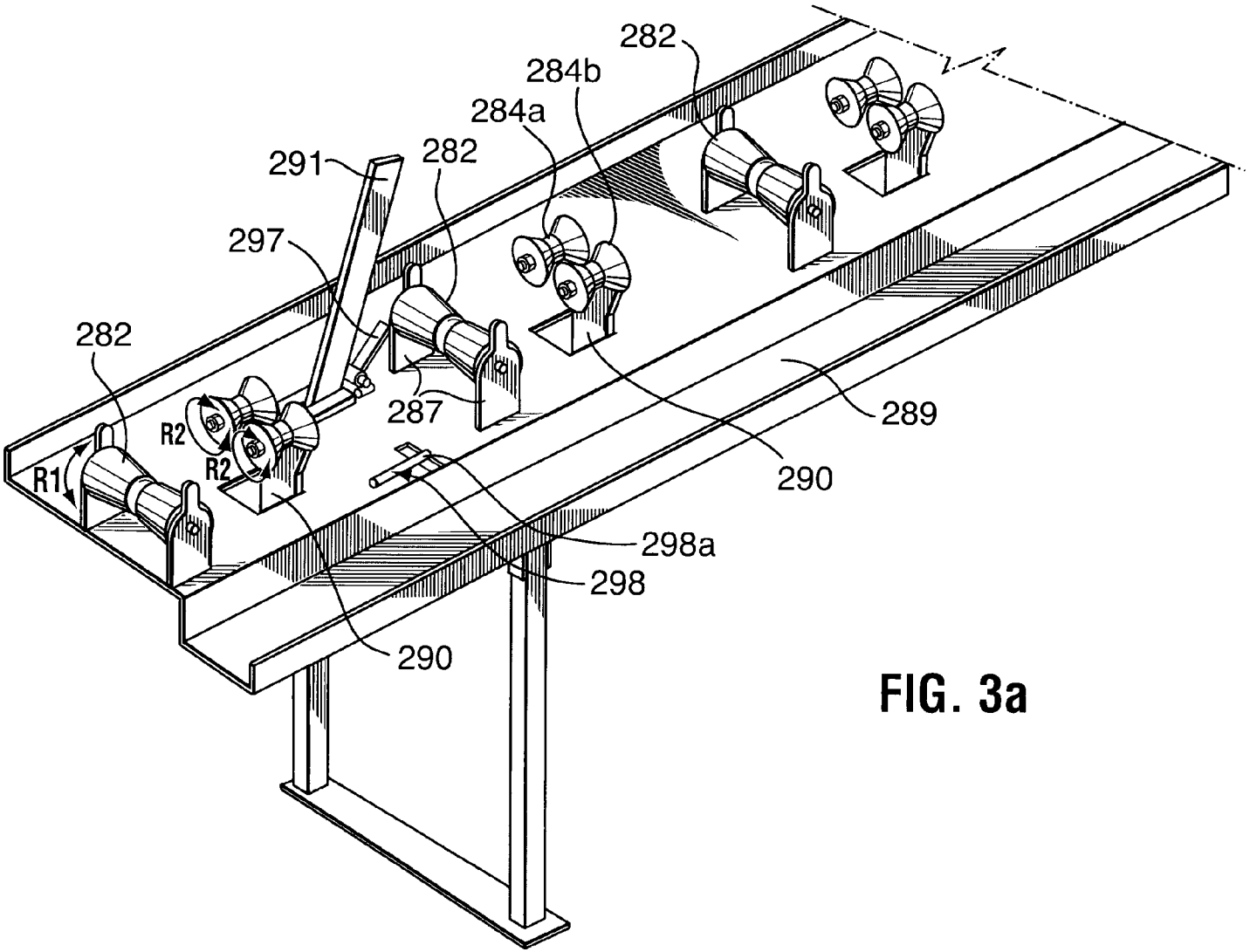
FIGS. 3*a* and 3*b* are top perspective views of a portion of the table of FIG. 3 in two modes of operation.
Figure 3B:
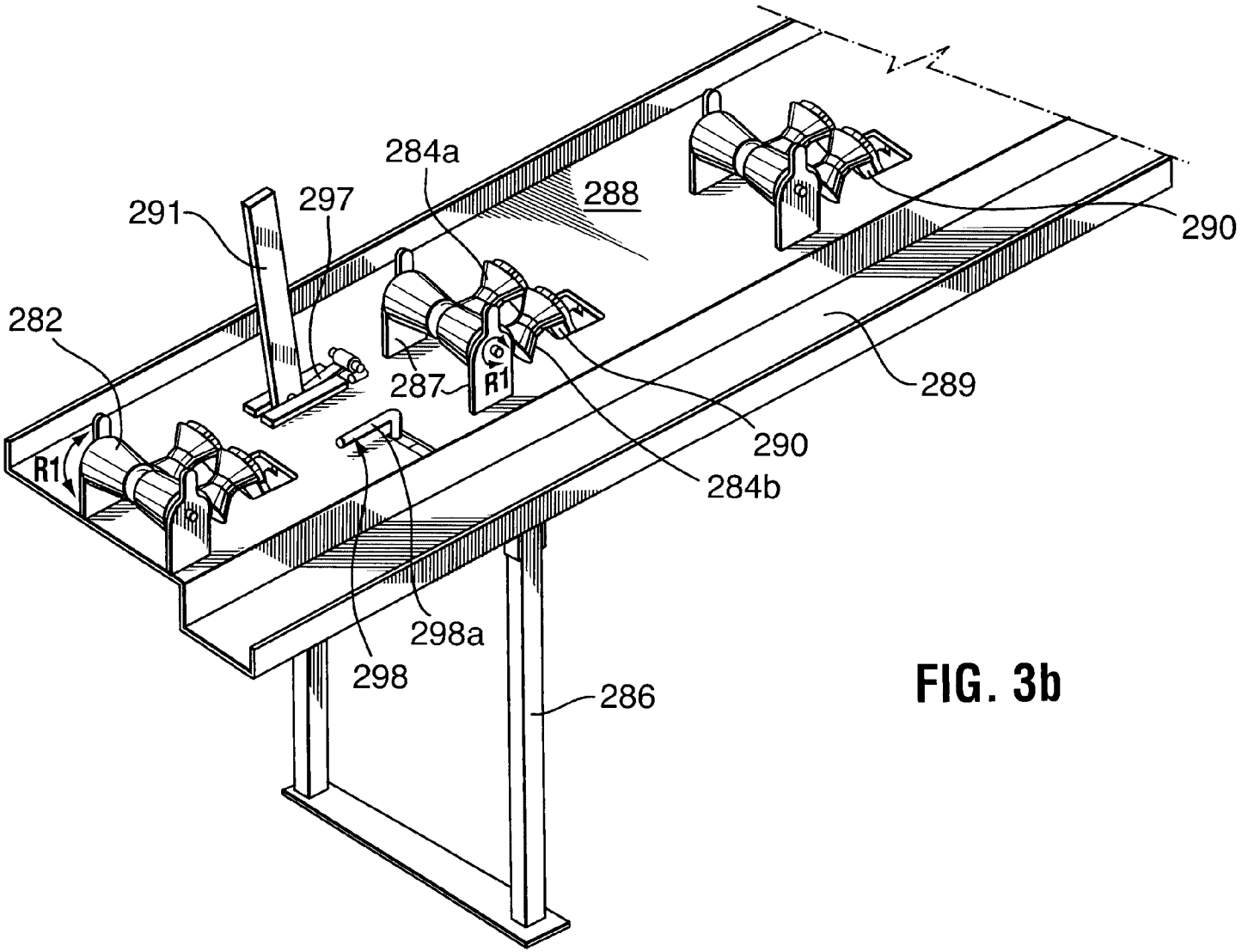

Lock 297 may, for example, include a latch that can be set (FIG. 3*b*) to secure actuator arm 291 against movement or released (FIG. 3*a*) to allow movement of arm 291.

Figure 3C:
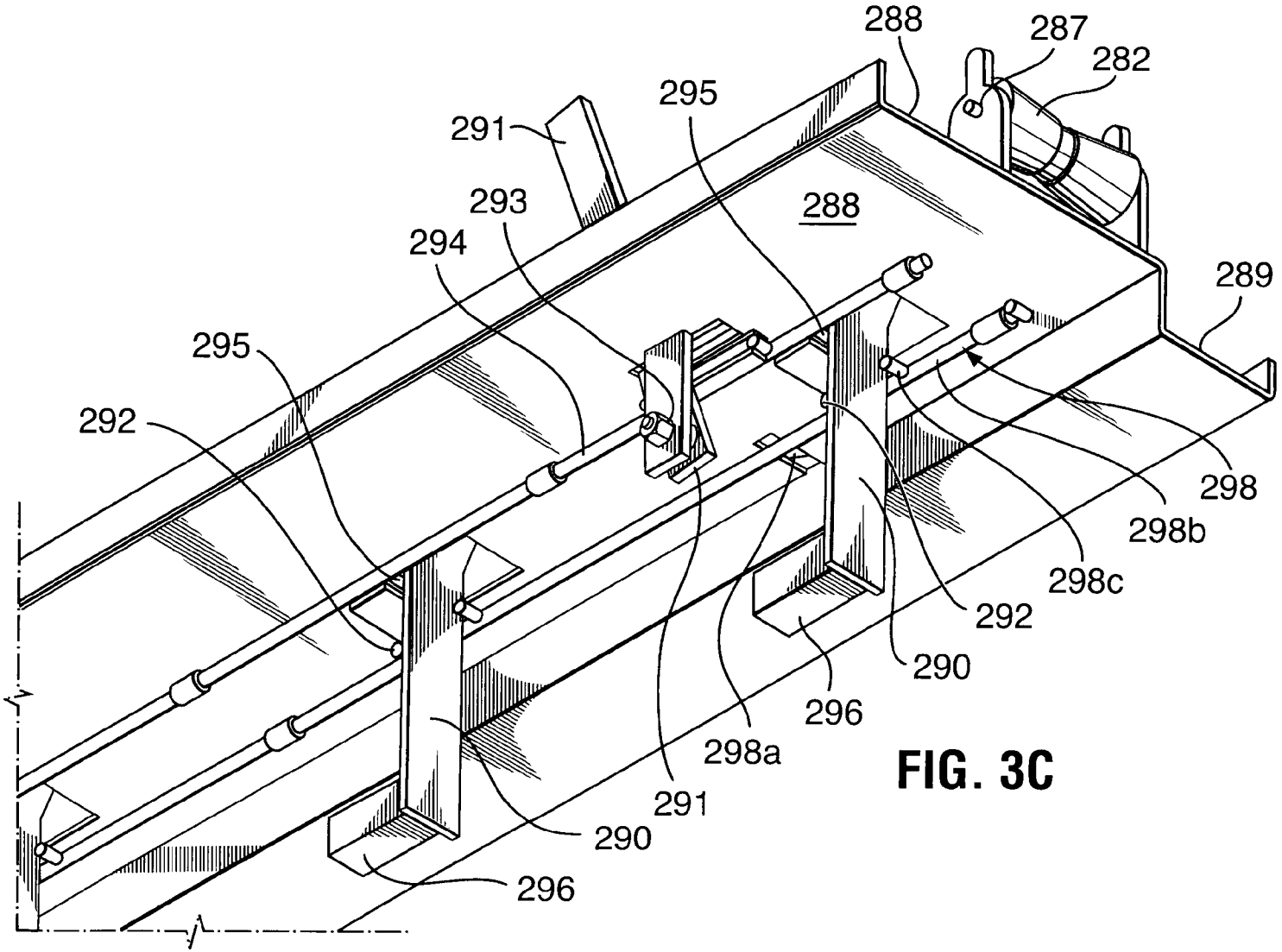
FIGS. 3*c* to 3*e* are perspective views from below of a portion of the perforating gun loading table of FIG. 2.

Lock 298, for example, may include a handle 298*a*, secured to a rod 298*b*, the rod having protrusions 298*c* thereon that each are positioned to act against one of the frames 290. Handle 298*a* can be moved to rotate rod 298*b* into (FIG. 3*c*) and out of (FIGS. 3*d* and 3*e*) a locking position relative to frames to prevent them from pivoting about the hinge. In particular, when weights 296 urge the frames into the upright position, protrusions 298*c* can be rotated to abut and brace the frames against movement. By moving rod 298*b*, the protrusions can be moved out of the pivotal path of the frames such that the frames are free to pivot on hinges 292.

In the illustrated embodiment, if arm 291 has not been actuated to drive the frames down and if lock 298 is unlocked, the frames are free to pivot about hinges 292. This is the configuration shown in FIG. 3*d*.

In the illustrated embodiment, hinges 292 are configured such that pivotal movement can be caused by a force applied to the rollers substantially along the long axis of the table, which is along path P. It may be useful to mount rollers 284 such that they can be moved into a recessed position by pivoting about hinges 292 in either direction. However, in the presently illustrated embodiment, frames 290 can only pivot in one direction to move to the recessed, inactive position. The frames are stopped from pivoting in the other direction by their abutment against work surface 288. In such an embodiment, the loading process may be considered to determine the effect of a single directional movement to the recessed position. For example, in the present embodiment, it may be useful that the rollers be mounted to pivot away from the end on which an empty housing is introduced for loading such that they can be pivoted down out of the way by the force of a member moving axially onto and along the table. This will be better understood by reference to the process described below.

With reference to FIGS. 2*a* to 2*q* and FIGS. 3*a* to 3*e*, a facility and a loading table, each alone or in combination may be useful in a process to load a perforating gun. Bear in mind that, generally, a perforating gun includes a housing including an outer housing 200 and a strip 202, which are each generally cylindrical. During a loading operation, strip 202 is removed from outer housing 200 and explosives are installed in and on the strip including shaped charges (not shown) and a detonating cord 206. Thereafter, the strip 202 and outer housing 200 are reassembled and sealed, as by use of end caps (not shown), to arrive at a loaded perforating gun 207.

During a loading process, starting materials are loaded to the facility and assembled therein. For example, starting with FIG. 2*a*, an outer housing 200 with a strip therein or separately may be loaded through pipe handling port 234 disposed on storage end wall 212 or through door 211. Outer housing 200 may be loaded onto any of the three loading wall racks 236*a* located in storage area 232 against each side wall 216. As shown in FIGS. 2*c* and 2*d*, some wall racks 236*a* are easily accessible through port 234 and some may be provided with rollers 238 to assist moving guns, as by axially sliding, in and out of the facility 210. Also, to assist movement of guns, outer shelf 234*b* may be used as a support and to initially align the gun components with the port outside the facility.

From loading wall rack 236*a*, outer housing 200 and the strip therein may be left on rack 236*a* for later handling, moved to another storage rack 236 or moved to processing area 254 for explosives loading.

When it is desired to load the strip (FIGS. 2*e* and 2*f*), an outer housing 200 and a strip (shown here telescopically assembled with the strip inside housing 200), are moved onto main transfer rack 242 and across transfer rack rollers 240. Rollers 240, being of the V-groove type, index and selectively position housing 200 and, therefore, strip 202 along a desired path P, which for example is selected with consideration as to the main loading axis of loading table 256 located in processing area 254. In some embodiments, the end of the gun outer housing 200 to be loaded may be positioned so that a few inches of the housing protrudes through port 250 of blast mitigation wall 252 and into loading area 254. In this fashion, the technician can extract strip 202 for loading, while leaving the housing off the loading table and for the most part in the storage area. As such, strip 202 is pulled out of gun outer housing 200 and is placed on loading table 256 in loading area 254 while the outer housing 200 remains at least in part outside the loading area 254. This reduces the amount of materials cluttering the loading area, alerts a worker on the storage area side that a perforating gun strip is being manipulated in the loading area and serves various other purposes.

Strip 202 may be placed on the table by simply axially pulling it from the housing. Such axial sliding motion may be permitted by rollers 282 on the loading table. To permit such axial movement, it may be desirable to operate the control system to allow the strip to be supported on and to ride over the axial movement-permitting rollers 282, while the rotational movement-permitting rollers 284 are in the recessed position. For example, locks 298 for the control system may be released to permit pivotal movement of rollers 284 and possibly actuator arm 291 for the control system may be driven to lower rotational rollers 284. If lock 298 is released and the actuator arm is driven to lower rollers 284, those rollers will be recessed out of the way of the advancement of the strip over rollers 282. If lock 298 is released, but the actuator arm is not driven to lower rollers 284, those rollers will be free to pivot out of the way as moved by the strips axial movement along the table. If lock 298 is not released, strip 202 is dragged over the rollers 284.

Figure 2G:
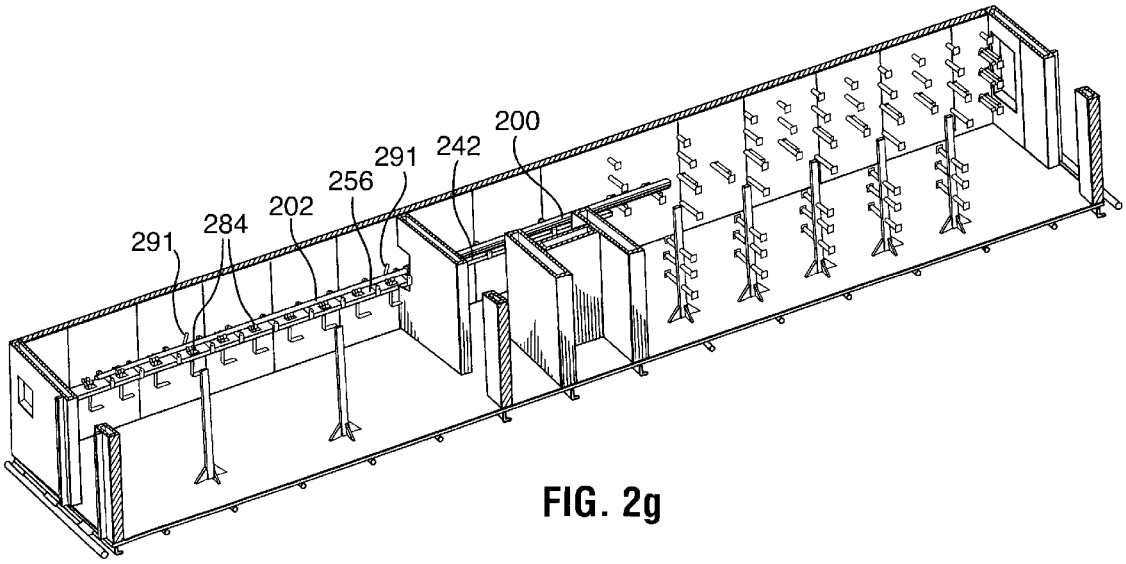

Once strip 202 is fully removed from outer housing 200, as illustrated in FIG. 2*g*, loading table roller control actuator arm 291 may be moved, if necessary, and lock 298 actuated, if necessary, (FIGS. 3*a* and 3*c*), to move and lock rollers 284 into the active position, thereby rendering strip 202 fully supported on rollers 284 and raised out of contact with rollers 282. In this position, rollers 284 that permit rotational movement of a cylindrical member thereon, permit the strip to be rotated about its long axis, but prevent axial movement along of the table. Thus, rollers 284, when locked in the upright position, serve as a safety to prevent strip 202 from moving axially along the table and to prevent gun outer housing 200 from moving axially onto loading table 256. This mode will be maintained until the lock 298 is released to permit pivotal movement of rollers 284.

Figure 2H:
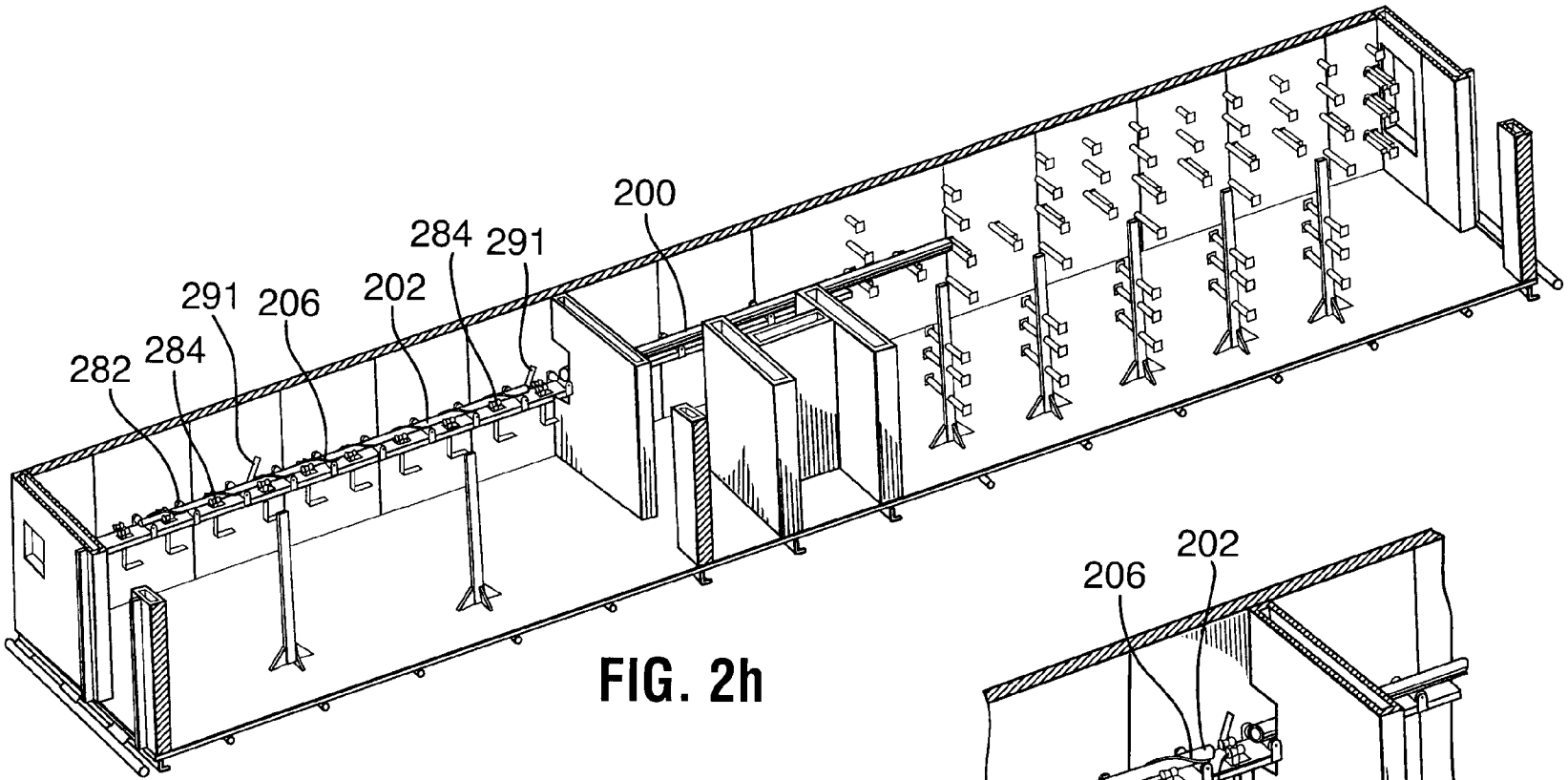
Figure 2I:
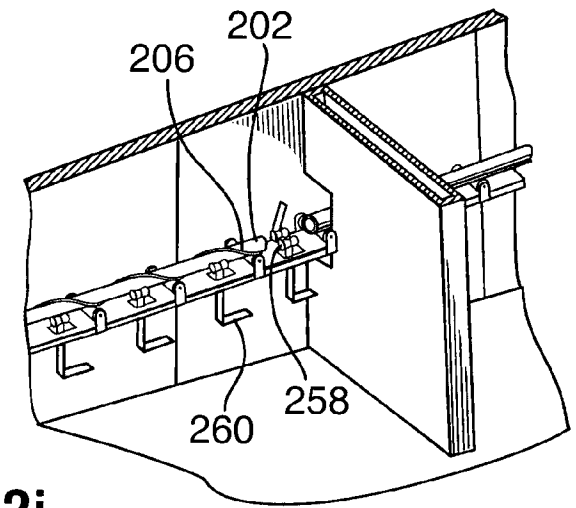
Figure 3D:
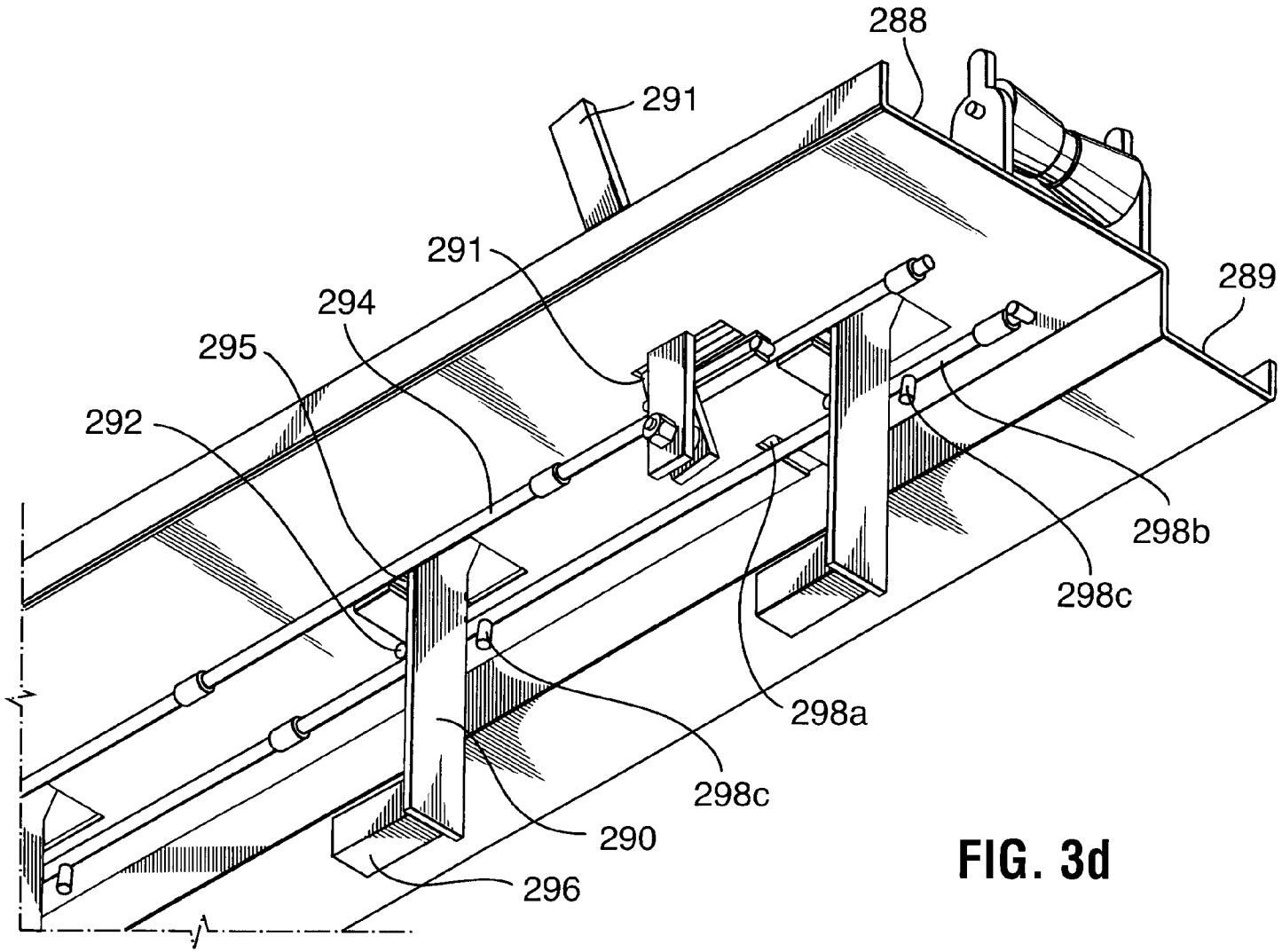
Figure 3E:
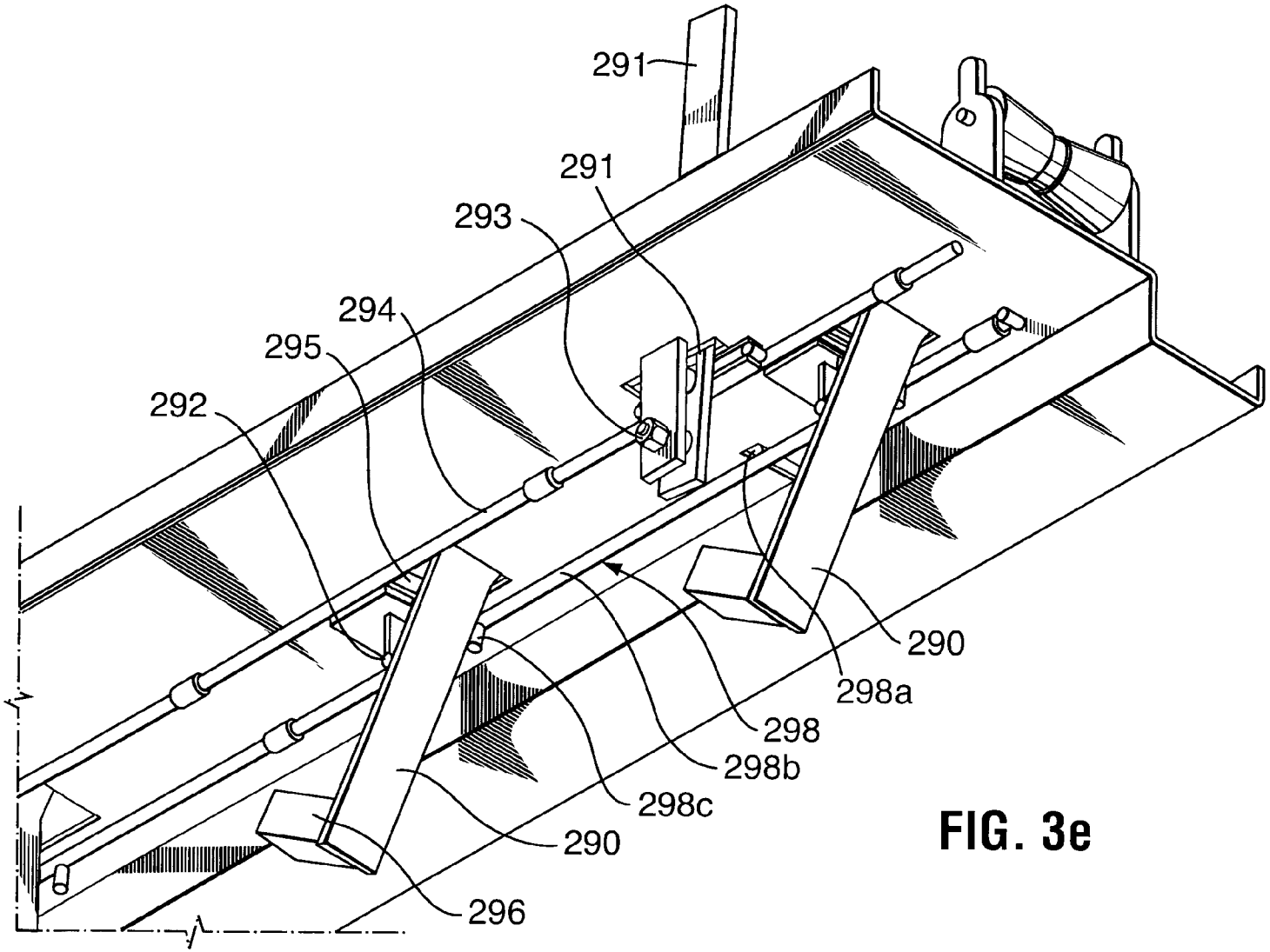

As shown in FIGS. 2*h* and 2*i*, once shaped charges (not shown) have been loaded into strip 202 and detonating cord 206 has been attached about the strip and to the shaped charges, the energetic materials loading is complete. Loading table rollers 284 may then be unlocked by actuation of lock 298, as shown in FIG. 3*d*.

Figure 2J:
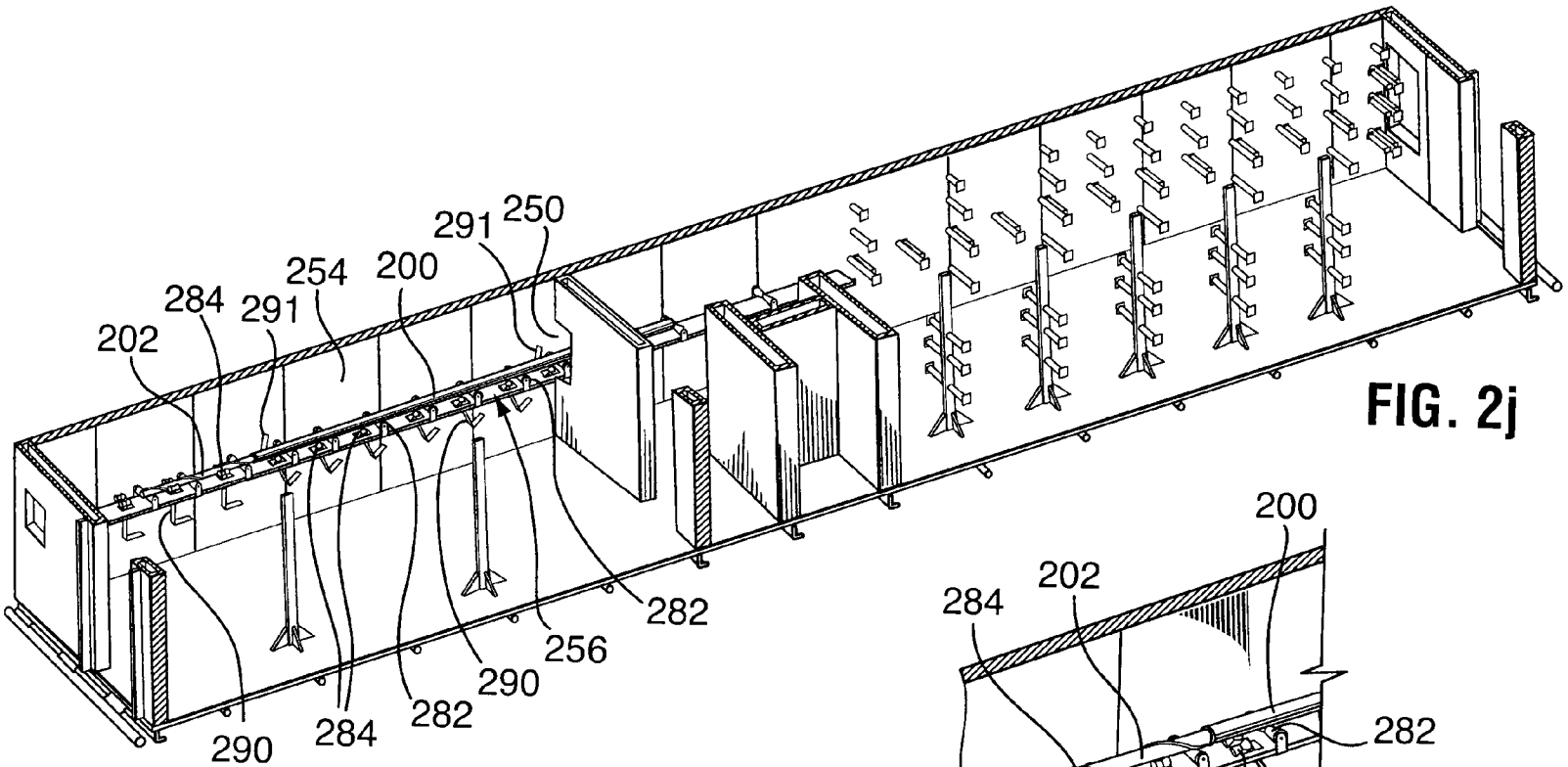
Figure 2K:
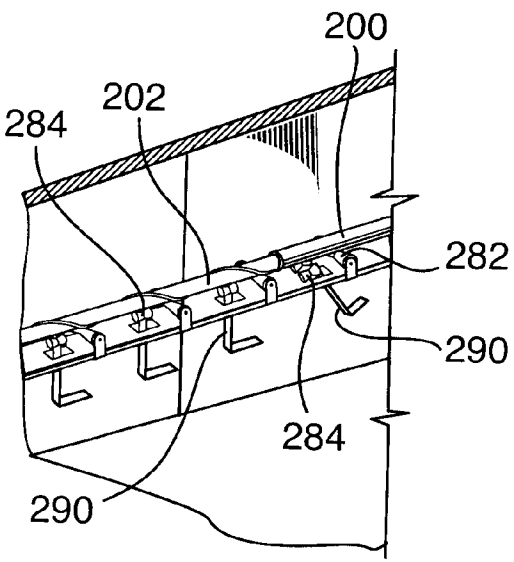
Figure 2I:
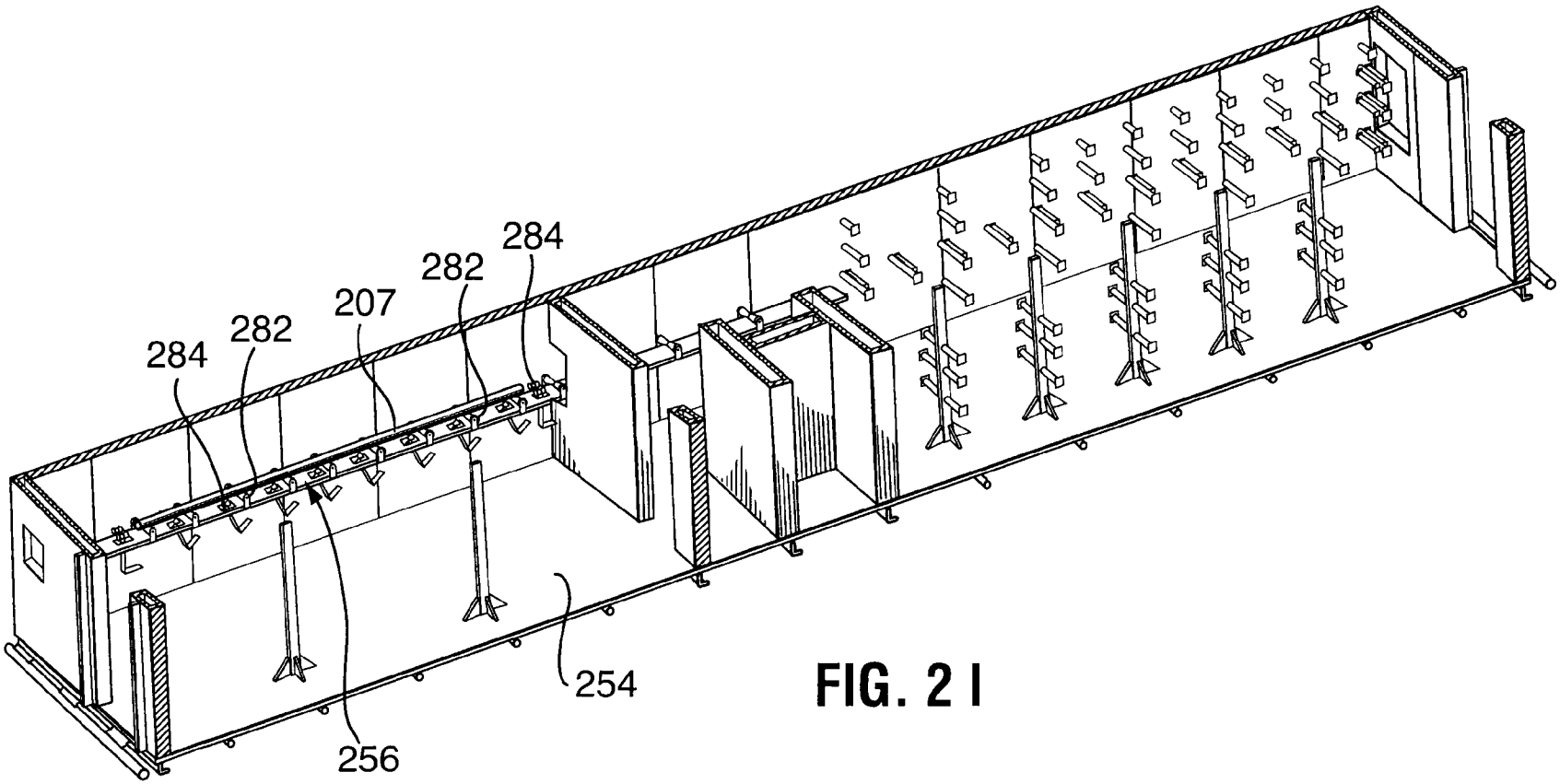

Referring now to FIGS. 2*j* and 2*k*, gun outer housing 200 may then be drawn through port 250 into loading area 254 and over the now-loaded strip 202. During movement of outer housing 200, rollers 284 which held strip 202 axially stationary are knocked down and pivot out of the way. Alternately, rollers 284 may be pivoted down by actuating arm 291 (FIGS. 3*b* and 3*e*) to move the strip onto axial movement-permitting rollers 282. Outer housing 200 may then be moved along axial movement-permitting rollers 282 to telescopically move over strip 202. FIG. 21, shows an assembled and loaded gun 207 where the outer housing has been fully drawn onto loading table 256 and has swallowed the loaded strip completely. In FIG. 21, gun 207 is now loaded and the subs or plastic end caps (not shown) can be installed.

Figure 2M:
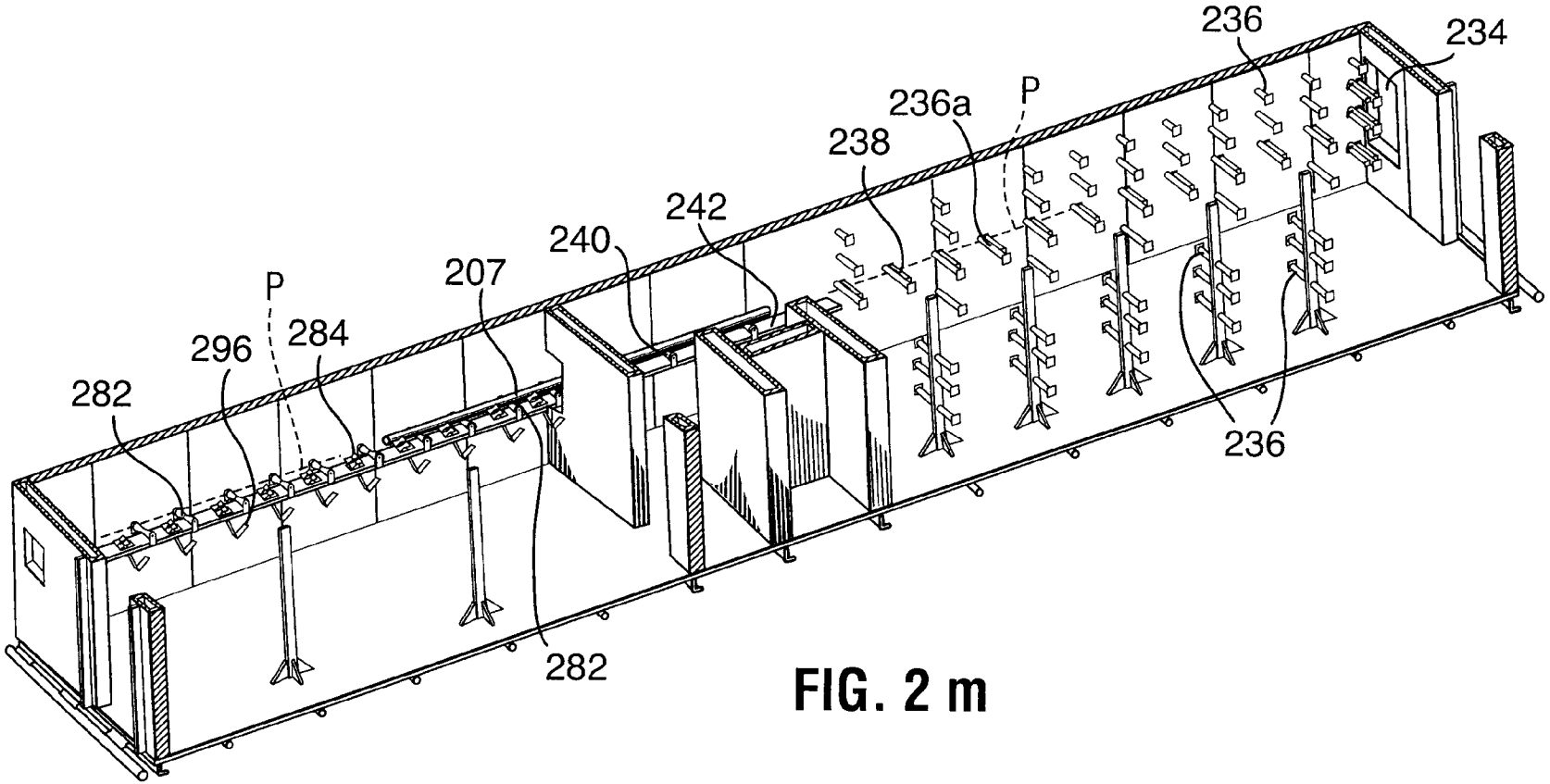
Figure 2N:
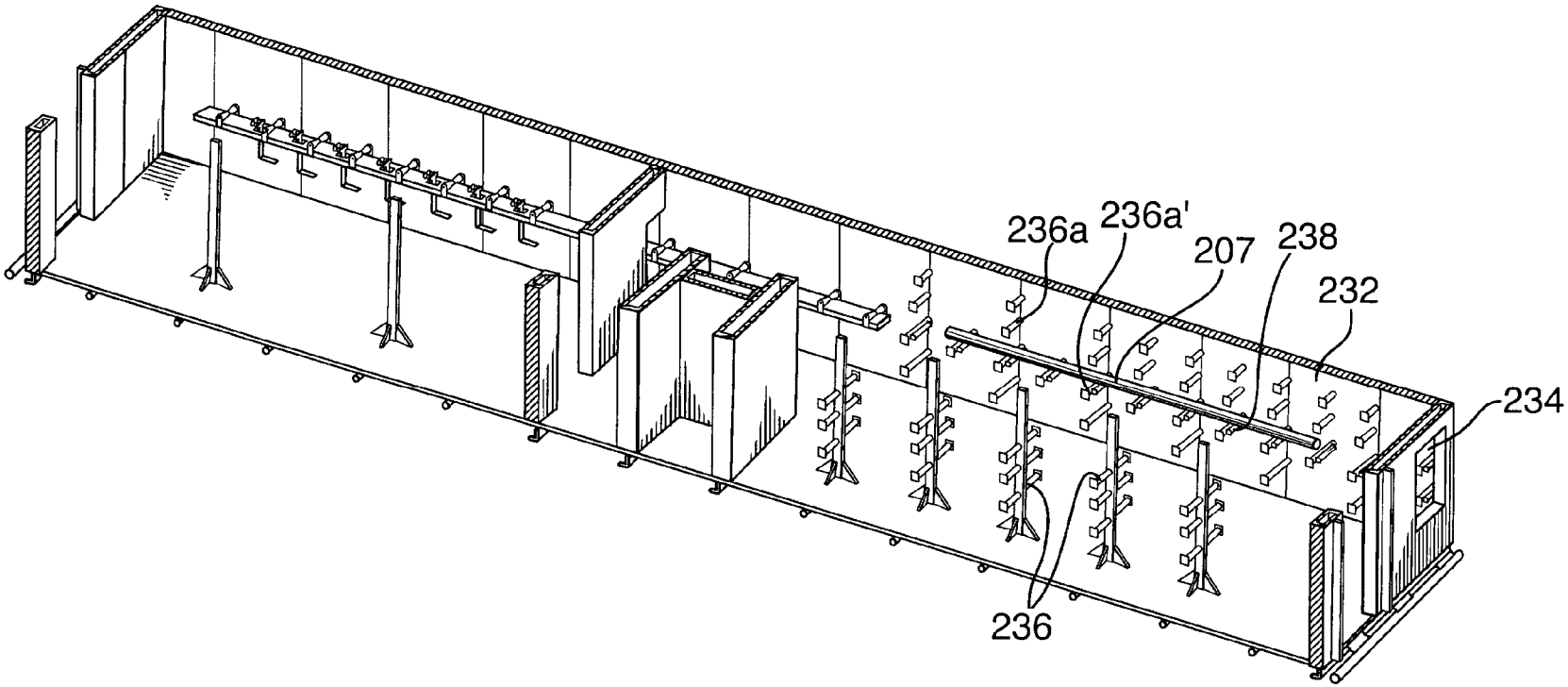

Once the gun is loaded with end caps installed, it can be removed from facility 210 or stored within the facility for later use. As shown in FIG. 2*m*, loading table roller control actuation arm 291 may be driven to positively retract and lock 297 may be actuated to lock down all rollers 284. This may be useful to prevent any scallops or shoulders on gun 207 from getting caught up on the loading table mechanisms as the gun moves on rollers 282 permitting axial movement, back out to the transfer rack 242. From there, gun 207 can be rolled along rollers 240 on rack 242 and rollers 238 on rack 236*a*' and passed out through port 234.

Figure 2O:
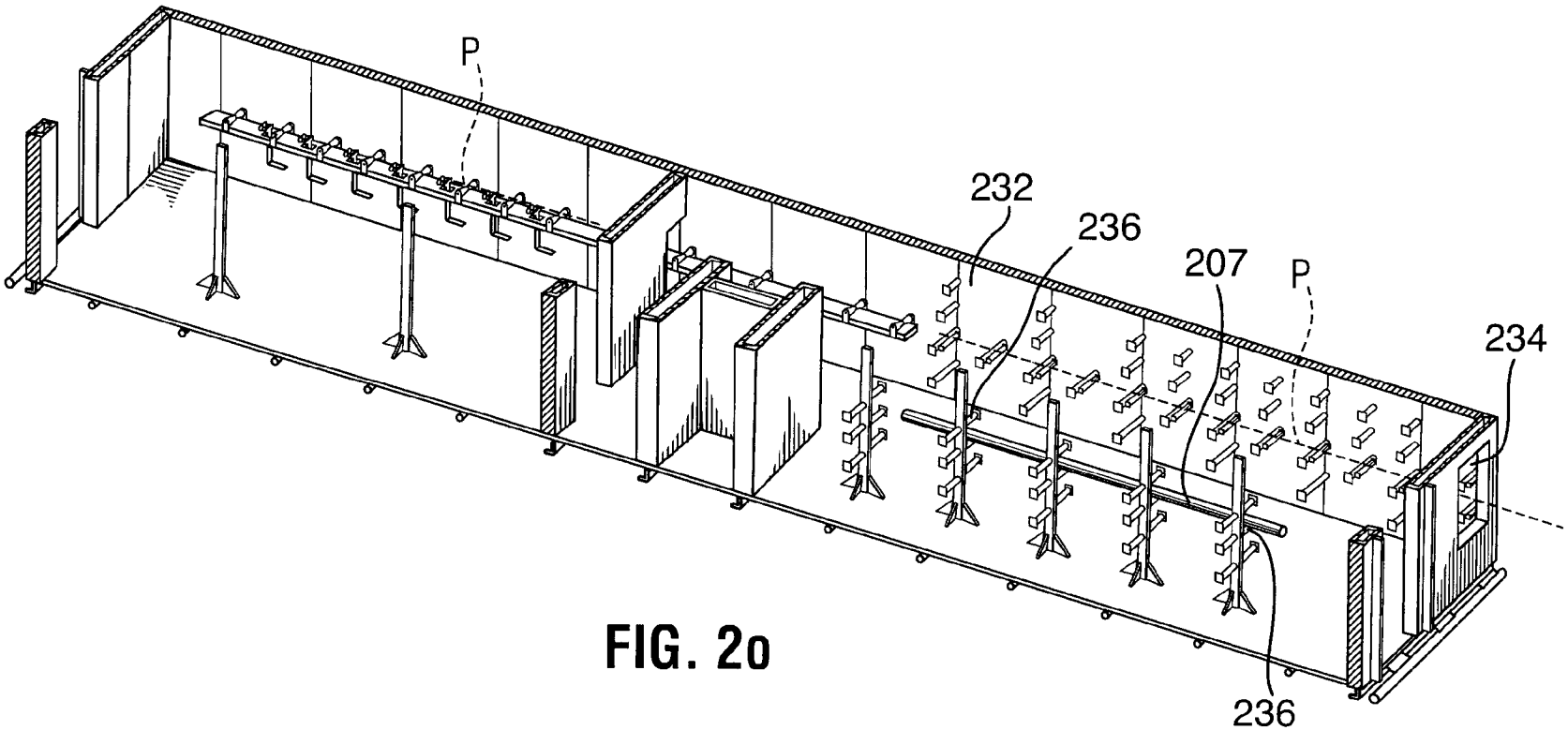

Alternately, loaded gun 207 can be stored on one of racks 236, 236*a*. Hoists may be used in storage area 232 to move the loaded gun to another rack 236, 236*a* out of path P, as shown in FIG. 2*o*.

Figure 2P:
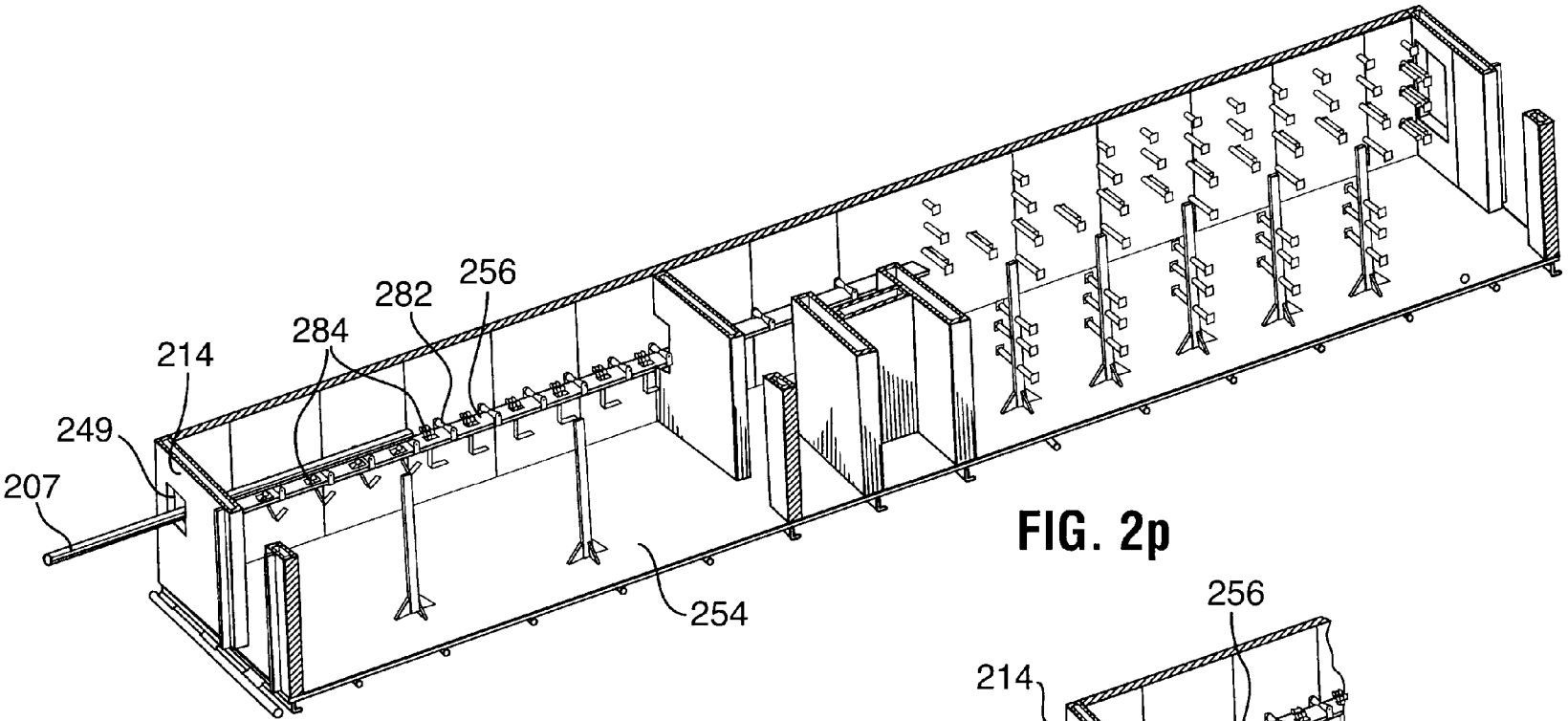
Figure 2Q:
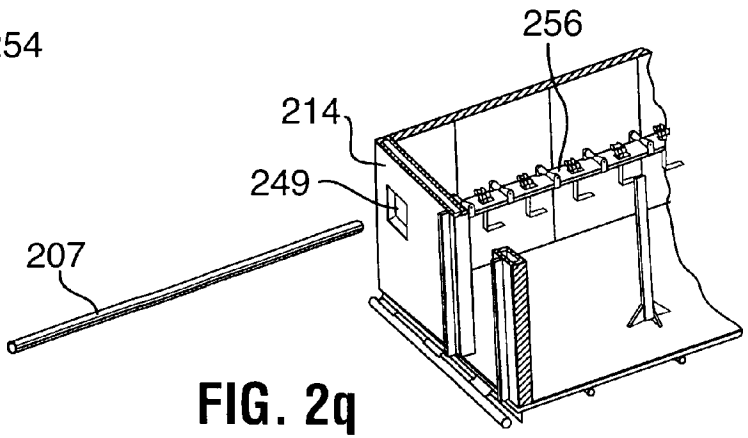

Alternatively, as shown in FIGS. 2*p* and 2*q*, gun 207 can be passed from loading area 254 out through port 249 in the end wall.

In the illustrated embodiment, facility 210 includes magazines 255*a*, 255*b*. Magazines 255*a*, 255*b* may have a blast mitigating wall 260 therebetween to substantially isolate the events in one magazine from events in the other. This arrangement of two magazines which are blast isolated permits primer cord to be stored separately from shaped charges, which provides a safeguard against detonation propagation and reduces the risk presented in a perforating gun loading facility.

A blast mitigating wall, as noted previously, may include a steel plate side walls and a cavity filled with shock absorbing materials such as sand, gravel, cement, polymers, etc. In this embodiment, a further shock absorbing layer may be installed between the open space of the magazine and the steel plate to further absorb blast energy. For example, magazine 255*b* may include a wooden panel 261 installed against, or spaced from, wall 260. This construction makes magazine 255*b* especially suitable for storage of the relatively unstable primer cord.

Each magazine may be secured by a lockable door 262*a*, 262*b*, such that access to the explosives can be controlled.

The arrangement and positioning of the magazines can further act to reduce the adverse effects of a blast occurring therein and may act to reduce sympathetic detonation between magazines and explosives present in other areas of the facility. For example, each magazine includes side walls 252*a*, 264 having blast mitigating properties. In the illustrated embodiment, walls 252*a*, 264 provide a shield between the magazine inner spaces and work areas 232, 254. Doors 262*a*, 262*b*, which inherently are relatively weaker components than blast mitigating walls, are positioned to open to areas where workers and/or explosives or explosive-containing guns will only occasionally be present. For example, in the illustrated embodiment, doors 262*a*, 262*b* are positioned to open to walk way 253 and transfer rack 242 where workers and explosives are generally not present for long periods.

The magazines may be sized to limit the quantity of explosives that can be stored therein. For example, the magazines together provide an overall storage space that is separated into a ⅓ portion (magazine 255*b*) and a ⅔ portion (magazine 255*a*) by wall 260. The primer cord can be stored in the ⅓ portion defined by magazine 255*b*, while the shaped charges are stored on the other side. The overall size of the magazines limit the total storage space to a suitable level, for example to accommodate less than about 25 kg. This approach can be used for the overall construction of perforating gun storage and perforating gun loading facilities, wherein external and internal blast mitigation walls are used to define blast isolated "rooms", each rated for an acceptable explosives storage amount based on local explosives handling regulations. For example, in the present facility 210, blast mitigation walls 212, 214, 216, 252, 252*a*, 260 and 264 act to define three substantially isolated areas including storage area 232, loading area 254 and magazines 255*a*, 255*b*, each of which may be rated for storage of about 25 kg(TNT) of explosives.

The facility can be constructed with consideration to the possibility of explosive events occurring. In the present facility 210, for example, the walls 216 and roof about blast mitigation wall 252 and magazines 255*a*, 255*b* are formed with a more rugged construction than the walls and roof in other areas to mitigate the development of shrapnel from these areas in the event of a blast.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A perforating gun loading bay comprising:

outer walls for mitigating the passage of explosive debris therethrough, the outer walls defining an inner space;

a port through at least one of the outer walls;

a pipe rack installed within the inner space, the pipe rack having pipe support surface and a long axis, the pipe rack positioned with its long axis aligned with the port; and a perforating gun loading table positioned within the inner space, the perforating gun loading table including a gun supporting surface and having a long axis, the perforating gun loading table long axis being substantially aligned with the long axis of the pipe rack and being positioned directly adjacent the pipe rack with its gun supporting surface positioned substantially continuously with the pipe support surface.

2. A perforating gun loading bay of claim 1 wherein the pipe rack includes rollers having an axis of rotation substantially orthogonal to the pipe rack long axis.

3. A perforating gun loading bay of claim 2 wherein the pipe rack rollers include V-grooves for pipe positional control.

4. A perforating gun loading bay of claim 1 wherein the perforating gun loading table includes rollers having an axis of rotation substantially orthogonal to the perforating gun loading table long axis.

5. A perforating gun loading bay of claim 1 wherein the perforating gun loading table includes rollers having an axis of rotation substantially parallel to and offset from the perforating gun loading table long axis.

6. A perforating gun loading bay of claim 1 wherein the perforating gun loading table includes axial movement-permitting rollers having an axis of rotation substantially orthogonal to the perforating gun loading table long axis and rotational movement-permitting rollers having an axis of rotation substantially parallel to and offset from the perforating gun loading table long axis.

7. A perforating gun loading bay of claim 1 further comprising a blast mitigation wall between the perforating gun loading table and at least a portion of the pipe rack.

8. A perforating gun loading bay of claim 7 wherein the pipe support surface and the gun supporting surface are in communication through a port of the blast mitigation wall.

9. A perforating gun loading bay comprising:

outer walls for mitigating the passage of explosive debris therethrough;

a storage area within the outer walls including storage racks for accommodating at least a perforating gun housing;

a perforating gun loading area within the outer walls;

a blast mitigation wall within the outer walls extending between the storage area and the perforating gun loading area;

a worker walk way through the blast mitigation wall; and an explosive storage magazine fixedly installed within the outer walls, the explosive storage magazine including blast mitigating walls defining an inner space, the blast mitigating walls each including plate steel side walls forming a cavity therebetween filled with shock absorbing materials.

10. The perforating gun loading bay of claim 9 wherein the explosive storage magazine, the storage area and the perforating gun loading area are each rated for storage of 25 kg explosives.

11. The perforating gun loading bay of claim 9 wherein the blast mitigating walls defining the explosive storage magazine are positioned as a portion of the blast mitigating wall between the storage area and the perforating gun loading area.

12. The perforating gun loading bay of claim 9 wherein the explosive storage magazine is positioned opposite the worker walk way through the blast mitigation wall to block direct linear access between the storage area and the perforating gun loading area.

13. The perforating gun loading bay of claim 9 further comprising a doorway through the blast mitigating walls through which access is gained to the inner space and wherein the doorway opens into a hallway between the storage area and the perforating gun loading area.

14. The perforating gun loading bay of claim 9 further comprising a doorway through the blast mitigating walls through which access is gained to the inner space and wherein the outer walls include end walls and side walls extending between the end walls and a portion of the side walls opposite the magazine doorway are constructed to be more rugged than the end walls.

15. The perforating gun loading bay of claim 11 wherein the doorway is positioned adjacent a side wall such that any explosive energy passing through the doorway is directed toward the side wall.

16. The perforating gun loading bay of claim 9 wherein the explosive storage magazine includes a blast mitigating dividing wall separating the inner space into a primer cord storage section and an explosive charges storage section, each section accessed by a doorway formed through the blast mitigating walls.

17. The perforating gun loading bay of claim 16 wherein the blast mitigating dividing wall substantially isolates explosive events in the primer cord storage section from the explosive charges storage section.

18. The perforating gun loading bay of claim 16 wherein the blast mitigating dividing wall includes plate steel side walls forming a cavity therebetween filled with shock absorbing materials.

* * * * *